US010604372B2

(12) United States Patent
Ohata et al.

(10) Patent No.: US 10,604,372 B2
(45) Date of Patent: Mar. 31, 2020

(54) SHEET STACKING DEVICE, SHEET POST-PROCESSING DEVICE, AND IMAGE FORMING DEVICE INCLUDING SAME

(71) Applicant: KYOCERA Document Solutions Inc., Osaka-shi (JP)

(72) Inventors: Shinobu Ohata, Osaka (JP); Terumitsu Noso, Osaka (JP); Masuo Kawamoto, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/174,343

(22) Filed: Oct. 30, 2018

(65) Prior Publication Data

US 2019/0127174 A1 May 2, 2019

(30) Foreign Application Priority Data

Nov. 1, 2017 (JP) ..... 2017-211736

(51) Int. Cl.
*B65H 31/34* (2006.01)
*B65H 35/00* (2006.01)
(Continued)

(52) U.S. Cl.
CPC ..... *B65H 31/34* (2013.01); *B65H 29/125* (2013.01); *B65H 29/14* (2013.01); *B65H 29/34* (2013.01);
(Continued)

(58) Field of Classification Search
CPC ..... B65H 29/14; B65H 29/125; B65H 29/34; B65H 29/52; B65H 31/02; B65H 31/10;
(Continued)

(56) References Cited

U.S. PATENT DOCUMENTS 5,244,200 A * 9/1993 Manzke ..... B65H 29/145 271/198
6,098,975 A * 8/2000 Kobayashi ..... B42C 1/12 270/58.09
(Continued)

FOREIGN PATENT DOCUMENTS

JP 2002-114431 4/2002
JP 2002-179326 6/2002

*Primary Examiner* — Leslie A Nicholson, III
(74) *Attorney, Agent, or Firm* — Gerald E. Hespos; Michael J. Porco; Matthew T. Hespos

(57) ABSTRACT

A sheet stacking device includes: a sheet discharge unit; a sheet stacking unit; a pair of cursors; and a control unit. The cursors perform widthwise alignment processing in which the cursors contact lateral end surfaces of the sheet to perform widthwise alignment. The control unit, before a leading end of the sheet reaches a sheet stacking surface, executes sheet guiding processing in which the cursors are positioned at a sheet guiding position to contact a bottom surface of the sheet and guide the sheet toward the sheet discharge direction. The control unit, when the leading end of the sheet passes a predetermined position, positions the cursors at a retracted position that is further outward than the lateral end surfaces of the sheet are, and once a trailing end of the sheet passes through the sheet discharge unit and the sheet is placed on the tray, executes the widthwise alignment processing.

12 Claims, 14 Drawing Sheets

(51) Int. Cl.

| | |
|---|---|
| ***B65H 37/04*** | (2006.01) |
| ***B65H 29/14*** | (2006.01) |
| ***B65H 29/52*** | (2006.01) |
| ***B65H 31/30*** | (2006.01) |
| ***B65H 31/02*** | (2006.01) |
| ***B65H 31/38*** | (2006.01) |
| ***B65H 31/10*** | (2006.01) |
| ***B65H 29/34*** | (2006.01) |
| ***B65H 29/12*** | (2006.01) |

(52) U.S. Cl.

CPC ..... *B65H 29/52* (2013.01); *B65H 31/02* (2013.01); *B65H 31/10* (2013.01); *B65H 31/3027* (2013.01); *B65H 31/38* (2013.01); *B65H 35/0086* (2013.01); *B65H 37/04* (2013.01); *B65H 2301/4212* (2013.01); *B65H 2301/4213* (2013.01); *B65H 2404/54* (2013.01); *B65H 2404/61* (2013.01); *B65H 2404/693* (2013.01); *B65H 2405/11151* (2013.01); *B65H 2801/27* (2013.01)

(58) Field of Classification Search

CPC .... B65H 31/34; B65H 31/38; B65H 31/3027; B65H 37/04; B65H 2301/4212; B65H 2301/4213; B65H 2404/54; B65H 2404/61; B65H 2404/693; B65H 2405/11151; B65H 2801/27

USPC ..... 270/58.12, 58.16, 58.17, 58.27

See application file for complete search history.

(56) References Cited

U.S. PATENT DOCUMENTS

| | | | | |
|---|---|---|---|---|
| 7,007,948 | B2 * | 3/2006 | Kamiya | B65H 31/26 270/58.12 |
| 7,014,183 | B2 * | 3/2006 | Tamura | B42C 1/12 270/58.08 |
| 7,175,174 | B2 * | 2/2007 | Terao | B42C 1/12 270/58.08 |
| 7,182,333 | B2 * | 2/2007 | Tamura | B65H 29/14 271/176 |
| 7,281,708 | B2 * | 10/2007 | Murata | B65H 29/34 270/58.08 |
| 7,300,052 | B2 * | 11/2007 | Tamura | B65H 31/34 270/58.12 |
| 7,568,688 | B2 * | 8/2009 | Nomura | B65H 29/58 270/58.08 |
| 7,883,081 | B2 * | 2/2011 | Iguchi | B65H 29/14 270/58.07 |
| 8,251,362 | B2 * | 8/2012 | Konishi | B65H 31/10 270/58.12 |
| 8,395,828 | B2 * | 3/2013 | Miyazaki | B65H 29/42 270/58.07 |
| 8,662,489 | B2 * | 3/2014 | Arai | B65H 31/10 270/58.07 |
| 8,672,314 | B2 * | 3/2014 | Sato | B65H 31/10 270/58.17 |
| 8,714,538 | B2 * | 5/2014 | Miyake | B65H 31/34 270/58.09 |
| 10,351,383 | B2 * | 7/2019 | Saito | B65H 31/3018 |
| 2002/0079642 | A1 | 6/2002 | Tamura et al. | |
| 2005/0189706 | A1 | 9/2005 | Tamura et al. | |
| 2015/0014916 | A1 * | 1/2015 | Saito | B65H 31/3018 271/185 |

* cited by examiner

SHEET STACKING DEVICE, SHEET POST-PROCESSING DEVICE, AND IMAGE FORMING DEVICE INCLUDING SAME

INCORPORATION BY REFERENCE

The present application is based on Japanese Patent Application No. 2017-211736 filed with the Japan Patent Office on Nov. 1, 2017, the contents of which are hereby incorporated by reference.

BACKGROUND

The present disclosure is related to a sheet stacking device that stacks sheets, a sheet post-processing device including the sheet stacking device, and an image forming device including the sheet post-processing device.

Sheet post-processing devices that perform post-processing, such as staple processing and hole punch processing, on sheets having undergone image forming are known. A sheet post-processing device includes: a sheet discharge unit that discharges sheets having undergone post-processing; and a tray which accepts sheets discharged by the sheet discharge unit and on which the sheets are stacked. The sheets stacked on the tray undergo widthwise alignment in which lateral end surfaces in the width direction of the sheets are put in alignment by a pair of cursors. Hence, the sheets are aligned on the tray.

SUMMARY

A sheet stacking device pertaining to one aspect of the present disclosure includes: a sheet discharge unit that discharges a sheet; a sheet stacking unit; a pair of cursors; and a control unit. The sheet stacking unit includes a tray which accepts the sheet discharged by the sheet discharge unit and on which the sheet is placed. The pair of cursors performs, with respect to the sheet placed on the tray, widthwise alignment processing in which the cursors contact lateral end surfaces of the sheet in a sheet width direction perpendicular to a sheet discharge direction to perform widthwise alignment.

The control unit, before a leading end of the sheet discharged by the sheet discharge unit reaches a sheet stacking surface at a top surface of the tray, executes sheet guiding processing in which at least one of the pair of cursors is positioned at a sheet guiding position that is further inward in the sheet width direction than a lateral end surface of the sheet is to contact a bottom surface of the sheet and guide the sheet toward the sheet discharge direction. Further, the control unit, when the leading end of the sheet discharged by the sheet discharge unit passes a predetermined position above the at least one cursor during the sheet guiding processing, positions the at least one cursor positioned at the sheet guiding position at a retracted position that is further outward in the sheet width direction than the lateral end surface of the sheet is, and once a trailing end of the sheet discharged by the sheet discharge unit passes through the sheet discharge unit and the sheet is placed on the tray, executes the widthwise alignment processing by the pair of cursors.

A sheet post-processing device pertaining to another aspect of the present disclosure includes: a post-processing mechanism that performs predetermined post-processing with respect to a sheet; and the above-described sheet stacking device, on which the sheet having undergone the post-processing by the post-processing mechanism is placed.

An image forming device pertaining to yet another aspect of the present disclosure includes: an image forming unit that forms an image on a sheet; and the above-described sheet post-processing device, which performs the post-processing on the sheet on which the image has been formed.

DETAILED DESCRIPTION

[Overall Configuration of Image Forming Device]

Figure 1:
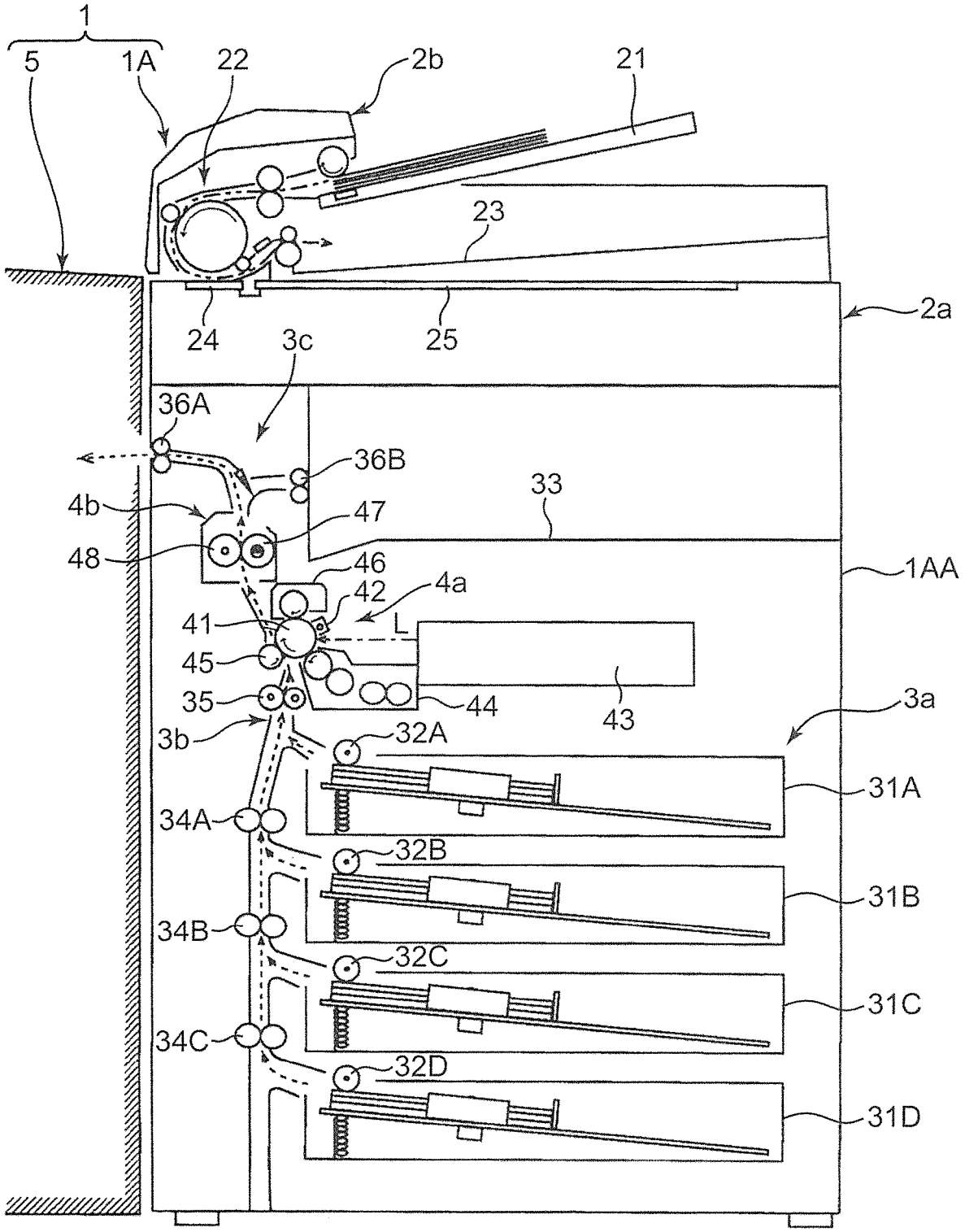
FIG. 1 is a cross-sectional view illustrating, in simplified manner, an image forming device including a sheet post-processing device pertaining to one embodiment of the present disclosure, and is a diagram illustrating an internal configuration of a main body part of the image forming device.

In the following, detailed description is provided of an embodiment of the present disclosure, with reference to the drawings. FIG. 1 is a cross-sectional view illustrating, in simplified manner, an image forming device 1 including a sheet post-processing device 5. The image forming device 1 includes: a main body part 1A that performs image forming processing with respect to sheets; and the sheet post-processing device 5, which is disposed adjacent to the main body part 1A and performs predetermined post-processing with respect to sheets/sheet stacks that have undergone the image forming processing. Here, the main body part 1A of the image forming device 1 is illustrated as a monochromatic copier of the so-called in-body paper discharge type. The main body part 1A, however, may be a color copier, a printer, a facsimile device, or a multifunctional printer provided with the functions of these devices.

The main body part 1A of the image forming device 1 includes: a main body housing 1AA; an image reading unit 2*a* disposed on top of the main body housing 1AA; and an automatic document feeder device (ADF) 2*b* disposed on the top surface of the image reading unit 2*a*. The main body housing 1AA houses therein: a paper feeding unit 3*a*; a transport path 3*b*; an image forming unit 4*a*; a fixing unit 4*b*; and a sheet discharge unit 3*c*.

The automatic document feeder device 2*b* automatically feeds document sheets to be copied toward a predetermined document reading position (the position at which a first contact glass piece 24 is installed). Meanwhile, the automatic document feeder device 2*b* is opened upward when users manually place document sheets at a predetermined document reading position (the position at which a second contact glass piece 25 is arranged). The automatic document feeder device 2*b* includes: a document tray 21 on which document sheets are placed; a document transport unit 22 that transports document sheets through a document reading position; and a document discharge tray 23 on which document sheets after reading are discharged.

The image reading unit 2*a* has a box-shaped housing structure, and has the first contact glass piece 24 and the second contact glass piece 25 fitted into the top surface thereof. The first contact glass piece 24 is for reading document sheets automatically fed from the automatic document feeder device 2*b*, and the second contact glass piece 25 is for reading document sheets that are manually set. The image reading unit 2*a* performs optical reading of images on document sheets.

The paper feeding unit 3*a* inside the main body housing 1AA includes a plurality of cassettes 31 that house sheets (a total of four cassettes 31, namely cassettes 31A, 31B, 31C, and 31D from the top in the example illustrated in FIG. 1). Each cassette 31 includes a paper feeding roller 32 (a total of four paper feeding rollers 32, namely paper feeding rollers 32A, 32B, 32C, and 32D from the top in FIG. 1) that is driven to rotate and sends sheets one by one onto the transport path 3*b* during image forming.

The transport path 3*b* is a transport path for transporting sheets inside the main body housing 1AA, from the paper feeding unit 3*a* to an in-body discharge tray 33 or to the sheet post-processing device 5. The transport path 3*b* is provided with: guide plates for guiding sheets; transport roller pairs 34 that are driven to rotate during sheet transportation (a total of three transport roller pairs 34, namely the transport roller pairs 34A, 34B, and 34C from the top in FIG. 1); and a resist roller pair 35. The resist roller pair 35 causes a sheet being transported to wait in front of the image forming unit 4*a* and sends out the sheet in accordance with a transfer timing of a toner image having been formed.

The image forming unit 4*a* generates toner images and transfers the toner images onto sheets. That is, the image forming unit 4*a* forms images on sheets. The image forming unit 4*a* includes a photoreceptor drum 41 and the following components disposed around the photoreceptor drum 41: a charger 42; an exposure device 43; a developing device 44; a transfer roller 45; and a cleaning device 46.

The photoreceptor drum 41 axially rotates, and electrostatic latent images and toner images are formed on the circumferential surface of the photoreceptor drum 41. The charger 42 uniformly charges the surface of the photoreceptor drum 41. The exposure device 43 has a laser light source and optical-system equipment such as a mirror and a lens, and irradiates the circumferential surface of the photoreceptor drum 41 with laser light L based on image data of document images and forms electrostatic latent images. The developing device 44 supplies toner onto the circumferential surface of the photoreceptor drum 41 in order to develop the electrostatic latent images having been formed on the photoreceptor drum 41. The transfer roller 45, together with the photoreceptor drum 41, forms a transfer nip part. By a transfer bias being applied to the transfer roller 45, toner images on the photoreceptor drum 41 are transferred onto sheets passing through the transfer nip part. The cleaning device 46 has a cleaning roller, etc., and cleans the circumferential surface of the photoreceptor drum 41 after toner image transfer.

The fixing unit 4*b* fixes the toner images having been transferred onto sheets. The fixing unit 4*b* includes: a heating roller 47 having a built-in heating element; and a pressurizing roller 48 that is placed in pressure contact with the heating roller 47. When a sheet having a toner image transferred thereon passes through a fixing nip part formed by the heating roller 47 and the pressurizing roller 48, the toner image is fixed onto the sheet. Sheets having undergone the fixing processing are sent to the sheet discharge unit 3*c*.

The sheet discharge unit 3*c* has: an externally discharging roller pair 36A for sending sheets having undergone image forming in the direction of the sheet post-processing device 5; and an internally discharging roller pair 36B for sending sheets having undergone image forming in the direction of the in-body discharge tray 33. The discharge roller pairs 36A, 36B are driven to rotate during discharge operation and discharge sheets to the outside of the device.

[Overall Configuration of Sheet Post-Processing Device]

The sheet post-processing device 5 performs predetermined post-processing with respect to sheets/sheet stacks having undergone the image forming processing in the main body part 1A. As the post-processing, hole punch processing in which binding holes are punched in sheets, staple processing in which staples are driven into sheet stacks, etc., can be mentioned for example.

Figure 2:
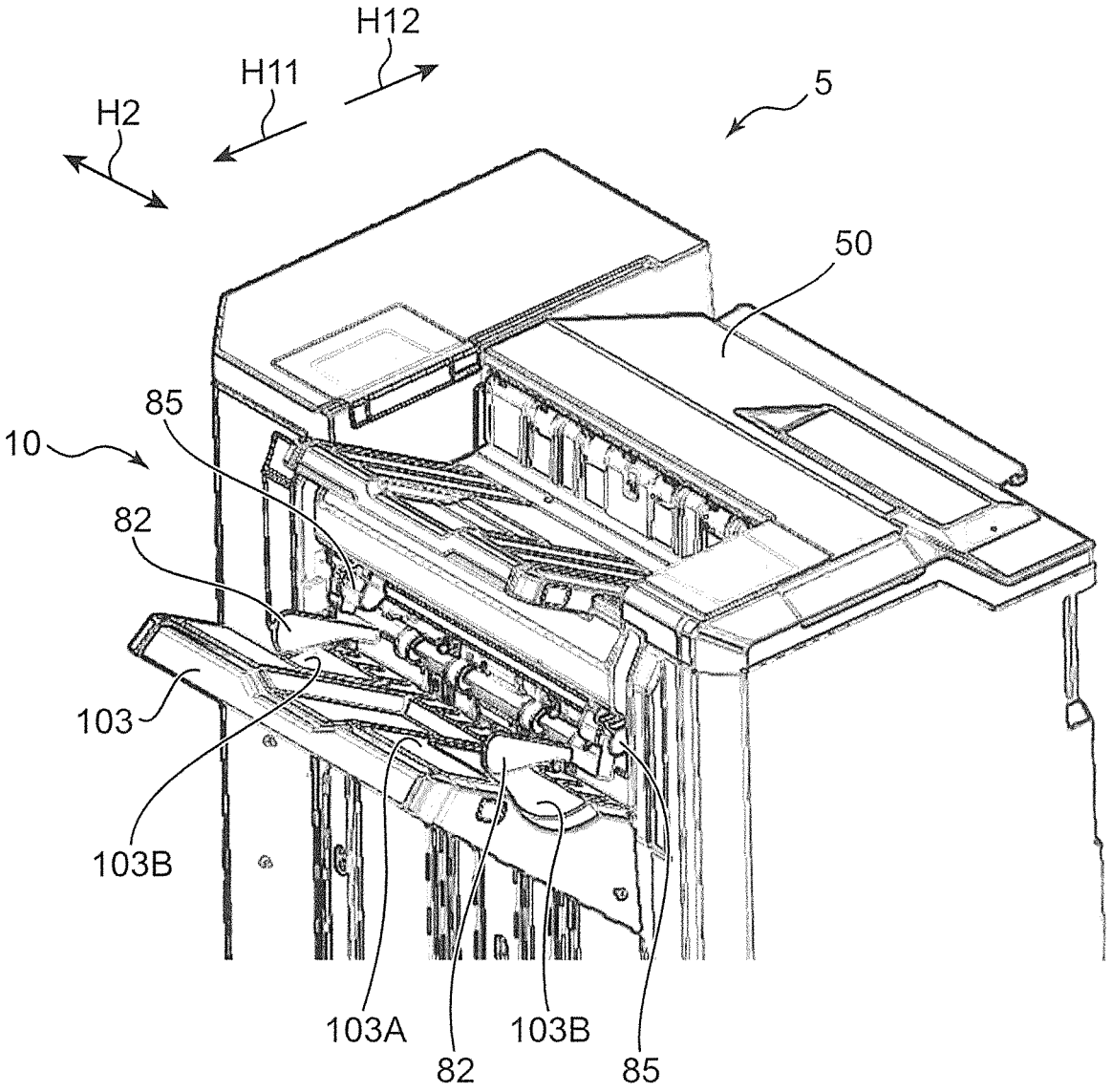
FIG. 2 is a perspective view illustrating an external appearance of the sheet post-processing device, which includes a sheet stacking device.
Figure 3:
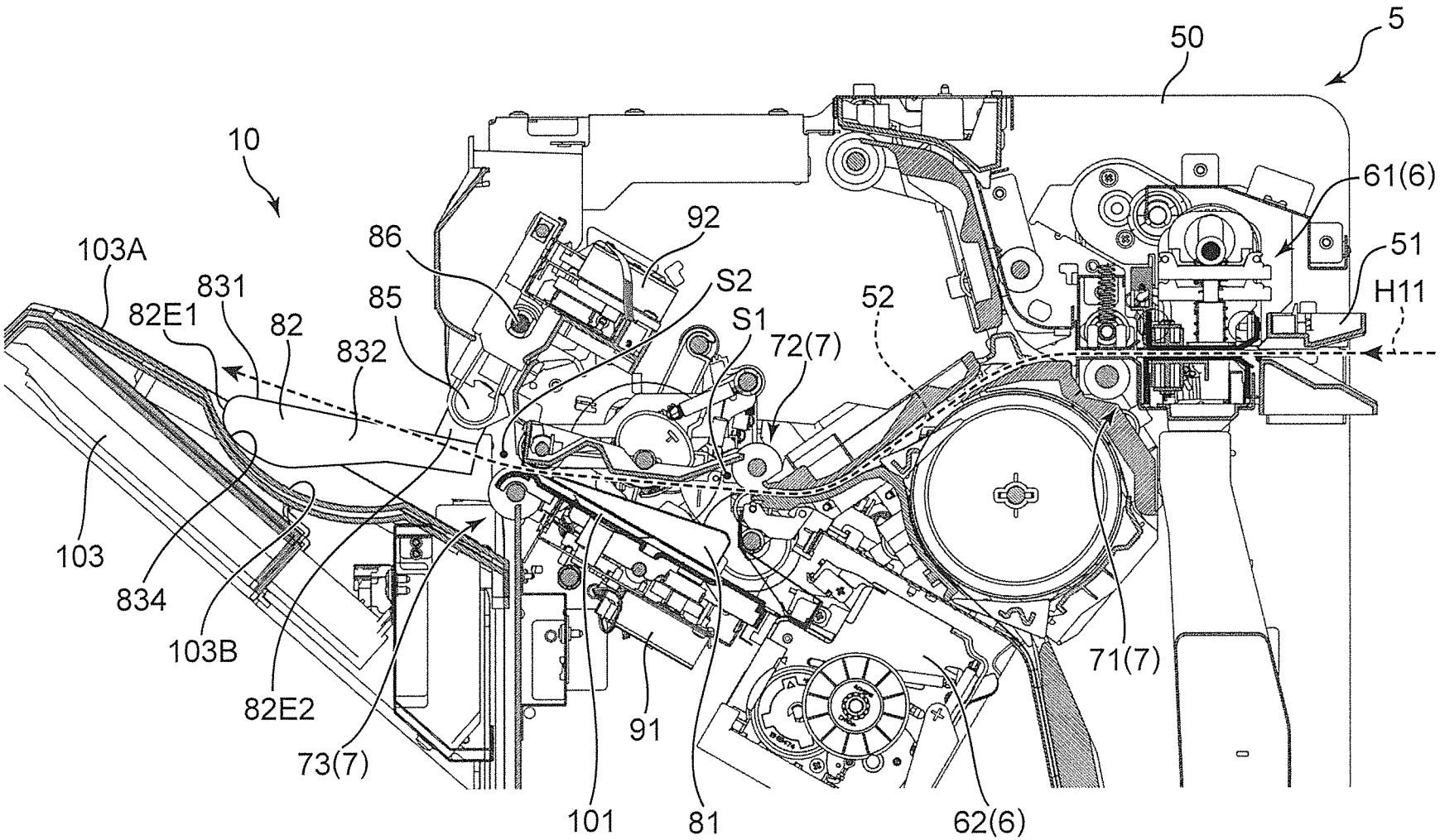
FIG. 3 is cross-sectional view illustrating an internal configuration of the sheet post-processing device.
Figure 4:
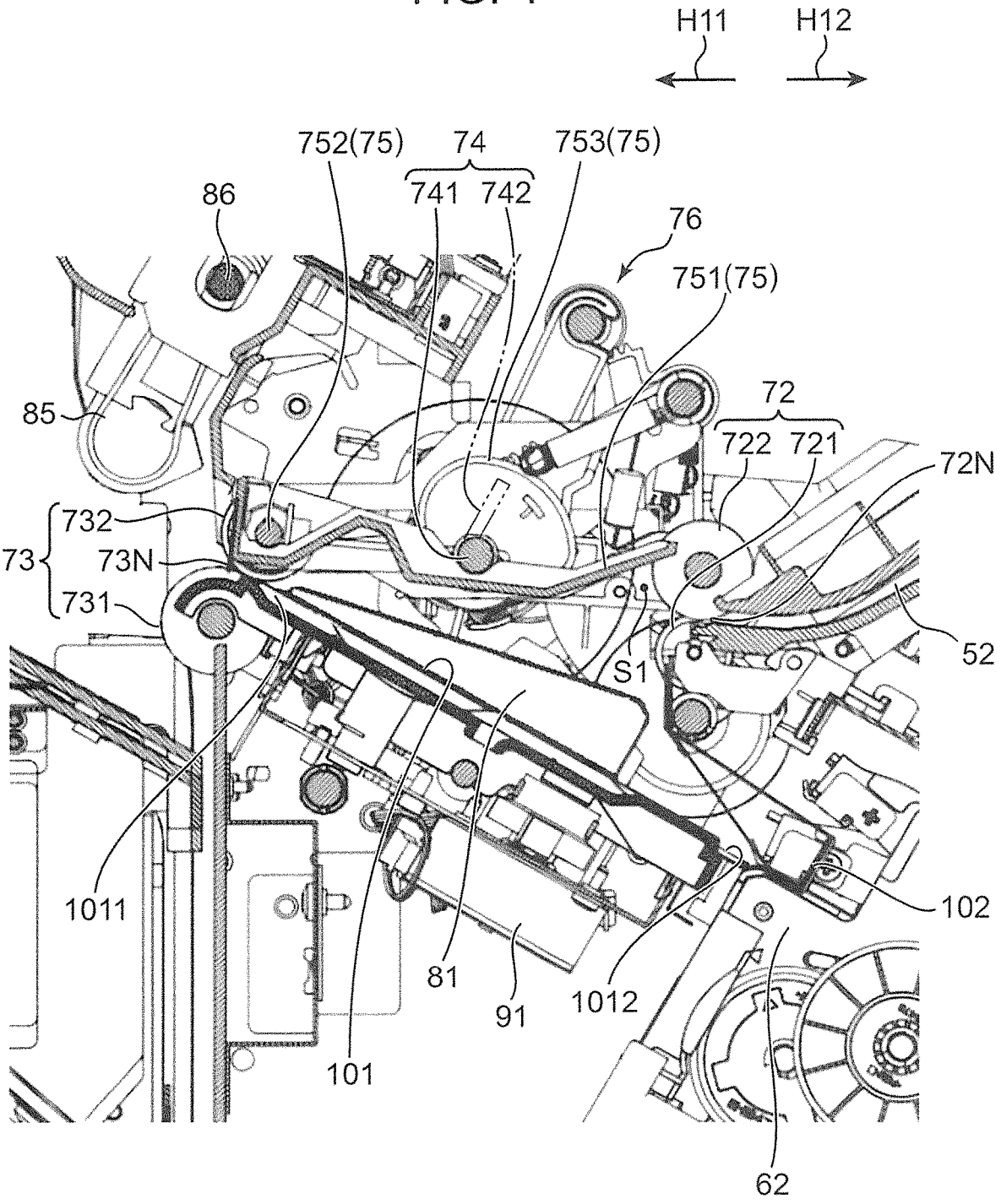
FIG. 4 is cross-sectional view illustrating a main part of the sheet post-processing device in enlarged state.

FIG. 2 is a perspective view illustrating the external appearance of the sheet post-processing device 5, and FIG. 3 is a cross-sectional view illustrating the internal configuration of the sheet post-processing device 5. FIG. 4 is cross-sectional view illustrating a main part of the sheet post-processing device 5 in enlarged state. The sheet post-processing device 5 includes a post-processing housing 50 disposed adjacent to the main body housing 1AA of the main body part 1A, and a post-processing mechanism 6, a sheet transport mechanism 7, and a sheet stacking device 10 that are arranged inside the post-processing housing 50.

The post-processing housing 50 is a box-shaped housing that has an internal space capable of housing various mechanisms that constitute the sheet post-processing device 5. Sheets that are sent out from the externally discharging roller pair 36A of the main body part 1A are sent into the post-processing housing 50. A sheet accepting unit 51 that accepts, to the inside of the post-processing housing 50, sheets having been sent out from the externally discharging roller pair 36A is provided in a lateral surface of the post-processing housing 50 that faces the main body housing 1AA. Further, a sheet transport path 52 is formed inside the post-processing housing 50. The sheet transport path 52 serves as the transport route of sheets having been accepted into the post-processing housing 50 by the sheet accepting unit 51.

The post-processing mechanism 6, inside the post-processing housing 50, performs predetermined post-processing to sheets. In the present embodiment, the post-processing mechanism 6 includes: a hole punch processing unit 61; and a staple processing unit 62.

The staple processing unit 62 is a first post-processing unit disposed below the sheet transport path 52. The staple processing unit 62 performs staple processing in which staples are driven into sheet stacks composed of a plurality of sheets. The staple processing here is processing for so-called edge binding, in which staples are driven into corner parts or end parts of sheet stacks.

The hole punch processing unit 61 is a second post-processing unit disposed at an upstream end of the sheet transport path 52 in a sheet transport direction H11. That is, the hole punch processing unit 61 is disposed adjacently at a downstream side in the sheet transport direction H11 with respect to the sheet accepting unit 51. The hole punch processing unit 61 performs hole punch processing of punching binding holes (processing traces) in sheets that have passed through the sheet accepting unit 51 and are transported along the sheet transport path 52. The hole punch processing here is processing in which binding holes are punched in sheets along a lateral end edge at one side of the sheets in a sheet width direction H2. The sheet width direction H2 is perpendicular to the sheet transport direction H11.

The sheet transport mechanism 7 is a mechanism that is disposed in the sheet transport path 52 and transports sheets in the sheet transport direction H11, which is along the sheet transport path 52. The sheet transport mechanism 7 includes: a transport roller pair 71; a first discharge roller pair 72; and a second discharge roller pair 73. As illustrated in FIG. 3, the transport roller pair 71, the first discharge roller pair 72, and the second discharge roller pair 73 line up in this order from upstream to downstream in the sheet transport direction H11.

The transport roller pair 71 is a sheet transport roller pair that is disposed adjacently at the downstream side in the sheet transport direction H11 with respect to the hole punch processing unit 61. The transport roller pair 71 rotationally drives and thereby transports sheets toward the downstream side, the sheets being either sheets having undergone the hole punch processing by the hole punch processing unit 61 or sheets having been exempted from the hole punch processing.

The first discharge roller pair 72 is a sheet transport roller pair that is disposed in the sheet transport path 52 between the upstream end and the downstream end in the sheet transport direction H11. As illustrated in FIG. 4, the first discharge roller pair 72 is constituted of: a first drive roller 721 that rotates by being provided with driving force from a transport drive unit 110 (in later-described FIG. 5); and a first passive roller 722 that passively rotates accompanying the rotation of the first drive roller 721. The circumferential surfaces of the first drive roller 721 and the first passive roller 722 are put in contact with one another with a predetermined nip pressure, and the first drive roller 721 and the first passive roller 722 form a first nip part 72N for nipping and transporting sheets.

A first sheet discharge sensing sensor S1 is disposed at an immediately downstream side of the first discharge roller pair 72 (see FIGS. 3 and 4). The first sheet discharge sensing sensor S1 is a sensor that optically detects sheets. The first sheet discharge sensing sensor S1 detects that a leading end of a sheet to be transported by the transport roller pair 71 has entered the first discharge roller pair 72. Further, the first sheet discharge sensing sensor S1 detects that a trailing end of a sheet transported by the first discharge roller pair 72 has passed through the first discharge roller pair 72.

The second discharge roller pair 73 is a sheet transport roller pair that is disposed in the sheet transport path 52 at the downstream end in the sheet transport direction H11. As illustrated in FIG. 4, the second discharge roller pair 73 is constituted of: a second drive roller 731 that rotates by being provided with driving force from the transport drive unit 110 (in later-described FIG. 5); and a second passive roller 732 that passively rotates accompanying the rotation of the second drive roller 731. The circumferential surfaces of the second drive roller 731 and the second passive roller 732 are put in contact with one another with a predetermined nip pressure, and the second drive roller 731 and the second passive roller 732 form a second nip part 73N for nipping and transporting sheets. The second nip part 73N is released during the staple processing by the staple processing unit 62, etc. In order to execute this release, the sheet post-processing device 5 includes a nip release mechanism 76 (see FIG. 4). The nip release mechanism 76 is provided with driving force from a nip release drive unit 112 (in later-described FIG. 5) and thereby raises the second passive roller 732 to release the second nip part 73N.

A second sheet discharge sensing sensor S2 is disposed at an immediately downstream side of the second discharge roller pair 73 (see FIG. 3). The second sheet discharge sensing sensor S2 is a sensor that optically detects sheets. The second sheet discharge sensing sensor S2 detects that a leading end of a sheet transported by the first discharge roller pair 72 has entered the second discharge roller pair 73. Further, the second sheet discharge sensing sensor S2 detects that a trailing end of a sheet transported by the second discharge roller pair 73 has passed through the second discharge roller pair 73.

The sheet post-processing device 5 includes a processing tray 101 which accepts sheets transported by the first discharge roller pair 72 and on which the sheets are stacked. The processing tray 101 is a tray that is disposed below the sheet transport path 52. The processing tray 101 accepts sheets that are to undergo the staple processing by the staple processing unit 62, the sheets being transported by the first discharge roller pair 72 in a state in which the second nip part 73N of the second discharge roller pair 73 has been released by the nip release mechanism 76. As illustrated in FIG. 4, the processing tray 101 is inclined so that a downstream end 1011-side in the sheet transport direction H11 is highest and the processing tray 101 becomes gradually lower toward an upstream end 1012-side. The downstream end 1011 of the processing tray 101 is located near the second discharge roller pair 73, and the upstream end 1012 of the processing tray 101 is located below the first discharge roller pair 72. Hence, the processing tray 101 is located below the sheet transport path 52 connecting the first nip part 72N and the second nip part 73N.

Further, as illustrated in FIG. 4, a receiving plate 102 is attached to the upstream end 1012 of the processing tray 101. The receiving plate 102 is a member having a U-shaped cross-sectional shape. The opening of the U-shape of the receiving plate 102 is directed toward the downstream end 1011 of the processing tray 101. Hence, the receiving plate 102 receives upstream ends (trailing ends) in the sheet transport direction H11 of sheets falling along the slope of the processing tray 101. Sheets that are to undergo the staple processing at the staple processing unit 62 are in a state of being positioned at a predetermined position in the processing tray 101 when the trailing ends of the sheets are in contact with the receiving plate 102.

A paddle unit 74 and a hitting unit 75 are disposed above the processing tray 101 (see FIG. 4).

The paddle unit 74 is provided in order to send sheets having been received by the processing tray 101 further toward the upstream end 1012-side of the processing tray 101 to bring the trailing ends of the sheets in contact with the receiving plate 102. That is, the paddle unit 74, with respect to sheets transported by the first discharge roller pair 72 in a state in which the second nip part 73N of the second discharge roller pair 73 has been released by the nip release mechanism 76, plays the role of sending the sheets in a direction H12 that is opposite the sheet transport direction H11 so that the sheets are drawn into the predetermined position in the processing tray 101. The paddle unit 74 includes: a rotation shaft 741; and a paddle blade 742 attached to the rotation shaft 741.

The rotation shaft 741 is a shaft extending linearly in the sheet width direction H2, and is disposed above the processing tray 101 at a predetermined distance from the processing tray 101. The rotation shaft 741 is supported to be axially rotatable and is driven to rotate by a draw-in drive unit 111 (in later-described FIG. 5). The paddle blade 742 is a sheet-shaped member and rotates together with the rotation shaft 741 when the rotation shaft 741 axially rotates. In doing so, a tip part of the paddle blade 742 contacts a sheet on the processing tray 101, and the sheet is drawn-in toward the upstream end 1012-side of the processing tray 101 due to the counter-clockwise rotation of the rotation shaft 741.

The hitting unit 75 is provided to force sheets transported by the first discharge roller pair 72 to fall onto the processing tray 101. The hitting unit 75 includes: a hitting member 751; and a swing shaft 752 to which the hitting member 751 is attached.

The hitting member 751 is constituted of a flat plate-shaped member that has a generally rectangular shape when viewed from above. The base end part of the hitting member 751, which is located near the downstream end, is disposed near the second discharge roller pair 73. The hitting member 751 hits, toward the processing tray 101, the vicinity of a trailing end of a sheet having passed through the first nip part 72N of the first discharge roller pair 72 in a state in which the second nip part 73N of the second discharge roller pair 73 has been released by the nip release mechanism 76. Hence, the sheet is forced to fall onto the processing tray 101. The hitting operation by the hitting member 751 is performed at the timing when the first sheet discharge sensing sensor S1 detects that the trailing end of the sheet transported by the first discharge roller pair 72 has passed through the first discharge roller pair 72. Further, once the sheet falls onto the processing tray 101, the hitting member 751 presses against the sheet on the processing tray 101 to decurl the sheet.

The swing shaft 752 is disposed further toward the downstream side in the sheet transport direction H11 than the rotation shaft 741 of the paddle unit 74 is, and is disposed to extend in the sheet width direction H2 above the processing tray 101, similarly to the rotation shaft 741. The hitting member 751 is attached to the swing shaft 752 at the base end part of the hitting member 751. That is, the hitting member 751 is attached to the swing shaft 752 in a cantilever state. Hence, the hitting member 751 is swingable about the axis of the swing shaft 752 (is swingable up and down).

The swinging operation of the hitting member 751 is realized by an eccentric cam 753 that is attached to the rotation shaft 741. The rear face of the hitting member 751 is placed in contact with a circumferential surface of the eccentric cam 753 with biasing force. When the eccentric cam 753 rotates due to the rotation of the rotation shaft 741, a large-diameter part and a small-diameter part of the eccentric cam 753 alternately contact the hitting member 751. Accordingly, when the eccentric cam 753 rotates, the upstream end-side of the hitting member 751 swings up and down about the axis of the swing shaft 752. The hitting member 751 swings downward and thereby hits, toward the processing tray 101, the vicinity of a trailing end of a sheet having passed through the first nip part 72N of the first discharge roller pair 72.

The processing tray 101 is provided with a pair of first cursors 81 (in FIGS. 3 and 4). The first cursors 81 forming a pair are cursors that perform widthwise alignment processing in which the cursors contact lateral end surfaces in the sheet width direction H2 of sheets stacked on the processing tray 101 and thereby correct the skewing of the sheets and perform widthwise alignment of the sheets. The first cursors 81 forming a pair are disposed spaced away from one another in the sheet width direction H2 and are capable of moving in the sheet width direction H2 with respect to the processing tray 101. The first cursors 81 forming a pair are moved in the sheet width direction H2 by a first moving unit 91 (in FIGS. 3 and 4). Sheets stacked on the processing tray 101 undergo staple processing by the staple processing unit 62 in a state in which the trailing ends of the sheets are in contact with the receiving plate 34 and the lateral edges of the sheets are supported by the first cursors 81 forming a pair. Note that description of the details of the moving operation of the first cursors 81 forming a pair is provided later.

The sheets that have been temporarily placed on the processing tray 101 and have undergone the staple processing by the staple processing unit 62 are discharged to the sheet stacking device 10 by the second discharge roller pair 73, the second nip part 73N of which is restored. The second discharge roller pair 73 constitutes a part of the sheet stacking device 10, and functions, in the sheet stacking device 10, as a sheet discharge unit that discharges sheets.

The sheet stacking device 10 is a device that stacks sheets having undergone the post-processing by the post-processing mechanism 6. The sheet stacking device 10 includes: a stacking tray 103; and a pair of second cursors 82.

The stacking tray 103 is disposed at the downstream side of the second discharge roller pair 73 in the sheet transport direction H11, and is a tray that becomes the final discharge location of sheets in the sheet post-processing device 5. The stacking tray 103 constitutes a sheet stacking unit that stacks sheets discharged by the second discharge roller pair 73, the sheets being either sheets having undergone the hole punch processing by the hole punch processing unit 61 or sheets having undergone the staple processing by the staple processing unit 62. As illustrated in FIG. 3, in the top surface of the stacking tray 103, recess parts 103B are formed in a sheet stacking surface 103A on which sheets are stacked.

Note that, when the second sheet discharge sensing sensor S2 detects that a trailing end of a sheet discharged by the second discharge roller pair 73 has passed through the second discharge roller pair 73, the stacking tray 103 is lowered in response to the detection. Hence, the position of the sheet that is located highest on the stacking tray 103 is maintained at a certain height position.

The second cursors 82 forming a pair are cursors that perform widthwise alignment processing in which the cursors contact lateral end surfaces in the sheet width direction H2 of sheets stacked on the stacking tray 103 and thereby correct the skewing of the sheets and perform widthwise alignment of the sheets. The second cursors 82 forming a pair are disposed spaced away from one another in the sheet width direction H2 and are capable of moving in the sheet width direction H2 with respect to the stacking tray 103. The second cursors 82 forming a pair are moved in the sheet width direction H2 by a second moving unit 92 (in FIG. 3).

As illustrated in FIG. 3, the second cursors 82 forming a pair are supported by holders 85 through which a shaft 86 is inserted. The shaft 86 is supported by the post-processing housing 50 to extend along the sheet width direction H2 above the second discharge roller pair 73. The holders 85 are supported by the shaft 86 to be movable along the sheet width direction H2. The holders 85 support the second cursors 82 forming a pair to be rotatable about base end parts 82E2 of the second cursors 82 that are located at the upstream side in the sheet transport direction H11 (sheet discharge direction), so that tip parts 82E1 of the second cursors 82 are swingable up and down. In other words, the second cursors 82 forming a pair move in the sheet width direction H2 accompanying the movement of the holders 85 along the shaft 86, and are supported to be rotatable about the base end parts 82E2 so that the tip parts 82E1 of the second cursors 82 are swingable up and down between a first position (first posture) where bottom surfaces 834 of the tip parts 82E1 are located below the sheet stacking surface 103A of the stacking tray 103 and a second position (second posture) where bottom surfaces 834 of the tip parts 82E1 are located above the sheet stacking surface 103A.

The up and down swinging operation of the tip parts 82E1 of the pair of second cursors 82 is executed by the second moving unit 92. When the bottom surfaces 834 of the tip parts 82E1 are positioned at the first position, the bottom surfaces 834 contact bottom surface parts of the recess parts 103B formed in the sheet stacking surface 103A of the stacking tray 103. Meanwhile, when the bottom surfaces 834 of the tip parts 82E1 are positioned at the second position, the bottom surfaces 834 are separated from the bottom surface parts of the recess parts 103B in the sheet stacking surface 103A. Note that description of the details of the moving operation and the swinging operation of the second cursors 82 forming a pair is provided later.

[Electrical Configuration of Sheet Post-Processing Device]

Figure 5:
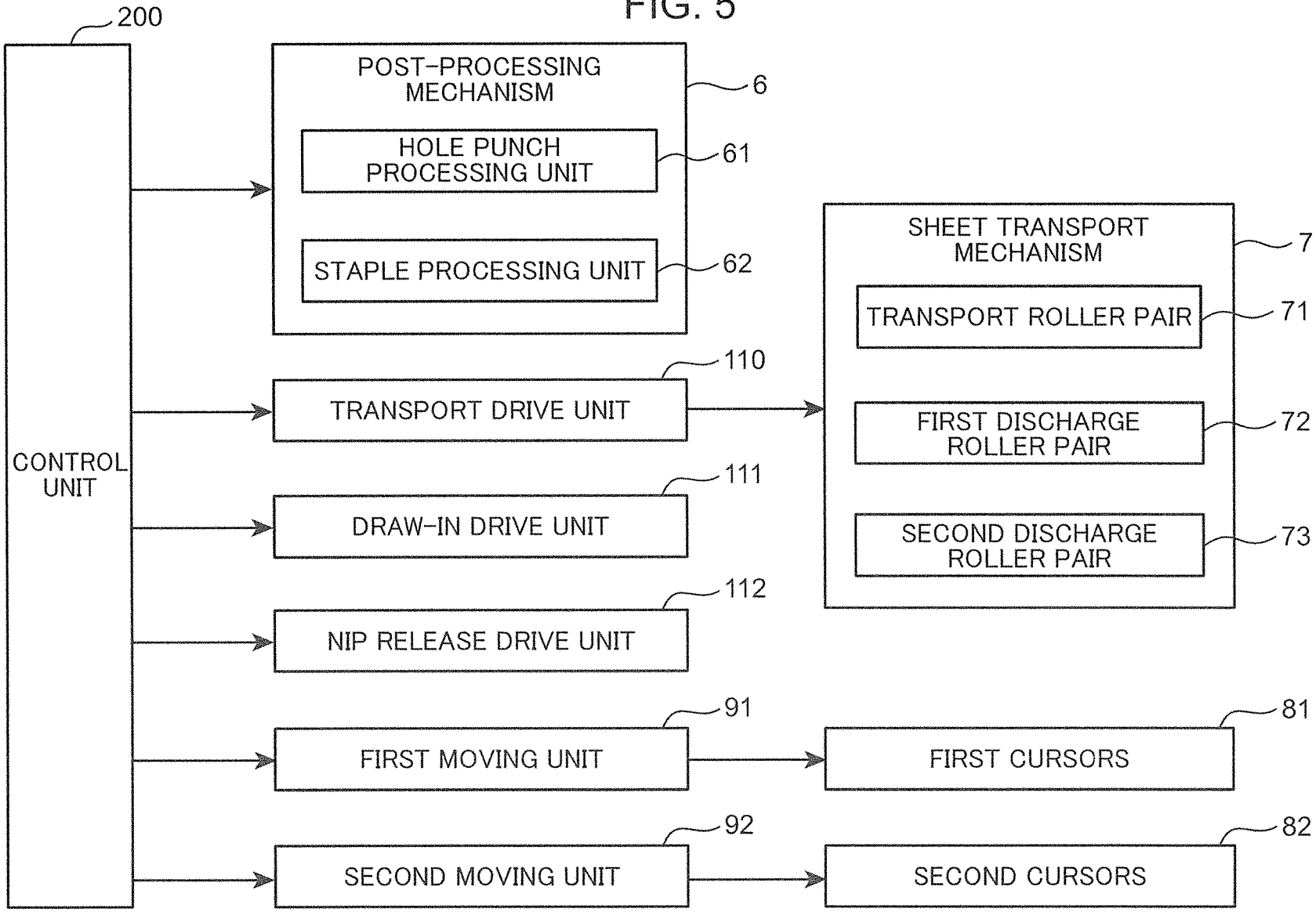
FIG. 5 is a block diagram illustrating an electrical configuration of the sheet post-processing device.

Next, description of the electrical configuration of the sheet post-processing device 5 is provided, with reference to the block diagram in FIG. 5. In addition to the post-processing mechanism 6, the sheet transport mechanism 7, and the sheet stacking device 10 described above, the sheet post-processing device 5 includes: a transport drive unit 110; a draw-in drive unit 111; a nip release drive unit 112; and a control unit 200.

The transport drive unit 110 is the drive source that rotationally drives the transport roller pair 71, the first discharge roller pair 72, and the second discharge roller pair 73 of the sheet transport mechanism 7. The draw-in drive unit 111 is the drive source that drives the paddle unit 74 and the hitting unit 75. That is, the draw-in drive unit 111 is the drive source that causes the paddle unit 74 to execute the draw-in operation of sheets to the processing tray 101 and causes the hitting unit 75 to execute the hitting operation for forcing sheets to fall onto the processing tray 101. The nip release drive unit 112 is the drive source of the nip release mechanism 76, or that is, the drive source for causing the nip release mechanism 76 to execute the release operation and restoration operation of the second nip part 73N of the second discharge roller pair 73.

The control unit 200 is constituted of: a central processing unit (CPU) that controls the operations of the respective components of the sheet post-processing device 5, including the sheet stacking device 10; a read only memory (ROM) that stores a control program; a random access memory (RAM) that is used as the CPU working area, etc. The control unit 200 controls the operations of the respective components of the sheet post-processing device 5, including the sheet stacking device 10, by the CPU executing the control program stored in the ROM.

The control unit 200 controls the drive of the transport drive unit 110 and thereby controls the rotation and the stop of rotation of the transport roller pair 71, the first discharge roller pair 72, and the second discharge roller pair 73. Further, the control unit 200 controls the hole punch processing operation by the hole punch processing unit 61 of the post-processing mechanism 6 and the staple processing operation by the staple processing unit 62 of the post-processing mechanism 6.

The control unit 200 controls the drive of the draw-in drive unit 111 and thereby controls the draw-in operation of sheets to the processing tray 101, which is realized by the rotation operation of the paddle blade 742 in the paddle unit 74, and controls the hitting operation (swinging operation) for forcing sheets to fall on the processing tray 101, which is realized by the hitting member 751 in the hitting unit 75.

The control unit 200 controls the drive of the nip release drive unit 112 and thereby controls the release operation and restoration operation of the second nip part 73N of the second discharge roller pair 73, which are realized by the nip release mechanism 76. For example, when the staple processing by the staple processing unit 62 is to be performed with respect to a sheet stack composed of a certain number of sheets, the control unit 200, by using the nip release drive unit 112 and causing the nip release mechanism 76 to operate, causes the nip release mechanism 76 to release the second nip part 73N after the first one of the sheets has been drawn into the processing tray 101. Further, the control unit 200 causes the second nip part 73N to be restored when the sheet stack is to be discharged onto the stacking tray 103 after the second and subsequent sheets have been drawn into the processing tray 101 and the staple processing has been executed.

<Regarding Movement Control, by Control Unit, of First Cursors with Respect to Processing Tray>

The control unit 200 controls the drive of the first moving unit 91 and thereby controls the moving operation of the pair of first cursors 81 forming a pair with respect to the processing tray 101. When the staple processing by the staple processing unit 62 is to be performed, the control unit 200 operates the first moving unit 91 so that the first cursors 81 forming a pair move with respect to the processing tray 101. That is, the control unit 200 causes the first moving unit 91 to operate so that the first cursors 81 forming a pair move with respect to the processing tray 101, when sheets transported by the first discharge roller pair 72 are stacked on the processing tray 101 in a state in which the second nip part 73N of the second discharge roller pair 73 has been released by the nip release mechanism 76.

In the sheet post-processing device 5, the processing tray 101 has sheets transported by the first discharge roller pair 72 stacked thereon, before the staple processing by the staple processing unit 62 is performed. Due to this, it is beneficial to maintain good alignment of sheets stacked on the processing tray 101 so that the staple processing by the staple processing unit 62 can be performed appropriately to the sheets.

Hence, the control unit 200 controls the operation of the first moving unit 91 and thereby executes first cursor moving processing in which the first cursors 81 forming a pair are moved with respect to the processing tray 101. As the first cursor moving processing, the control unit 200 executes: sheet supporting processing; sheet support cancelling processing; and widthwise alignment processing.

Figure 6A:
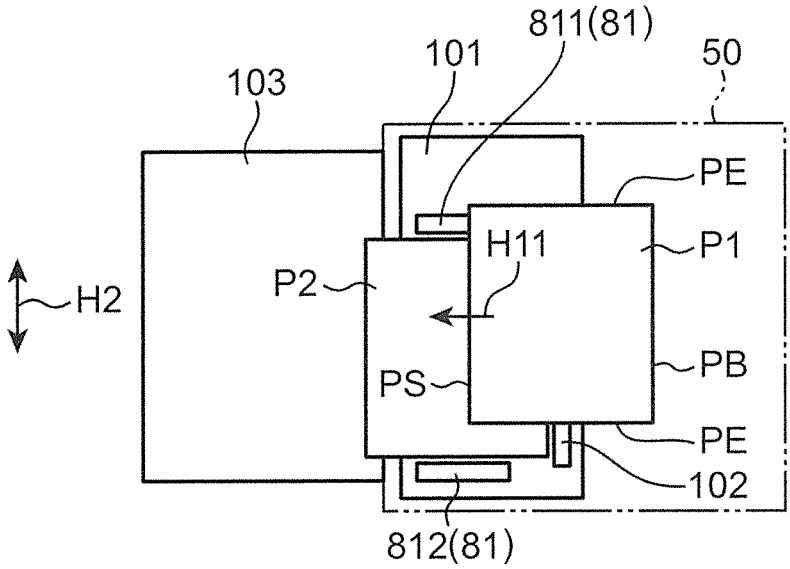
FIGS. 6A to 6C are schematic diagrams for describing a moving operation of first cursors with respect to a processing tray, and are plan views when seen from above.
Figure 6B:
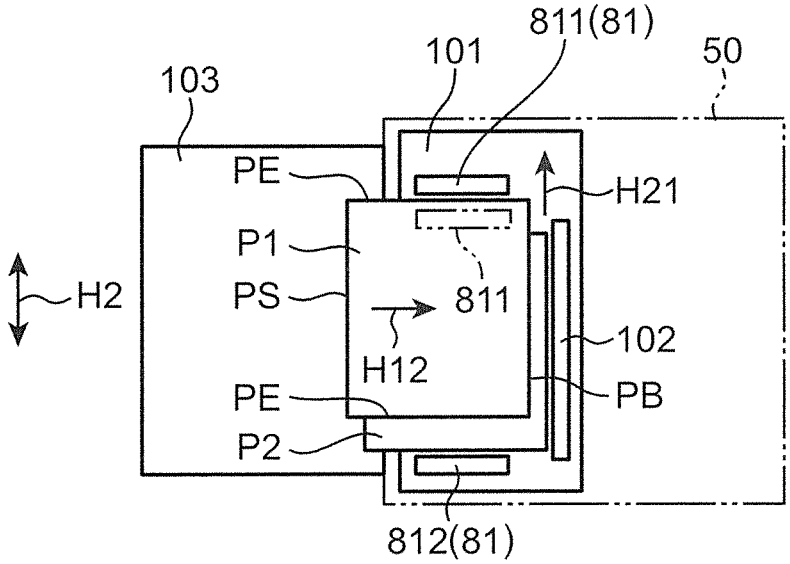
Figure 6C:
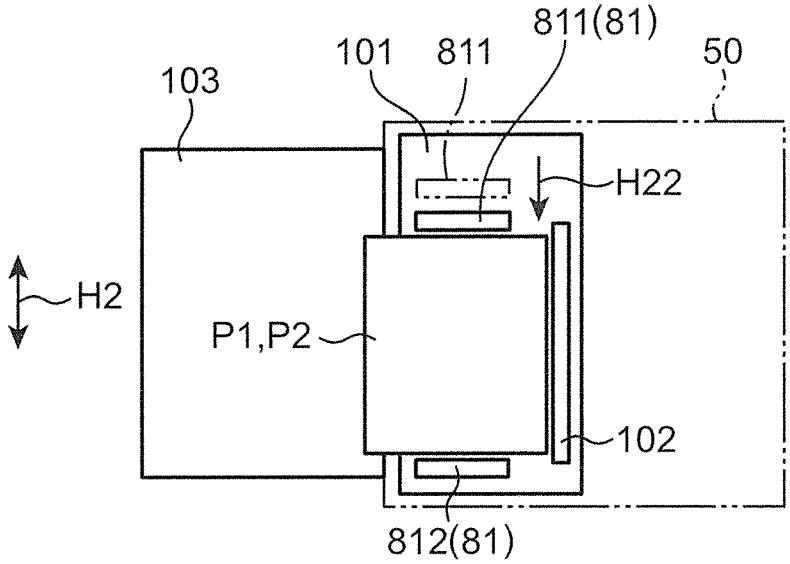
Figure 7A:
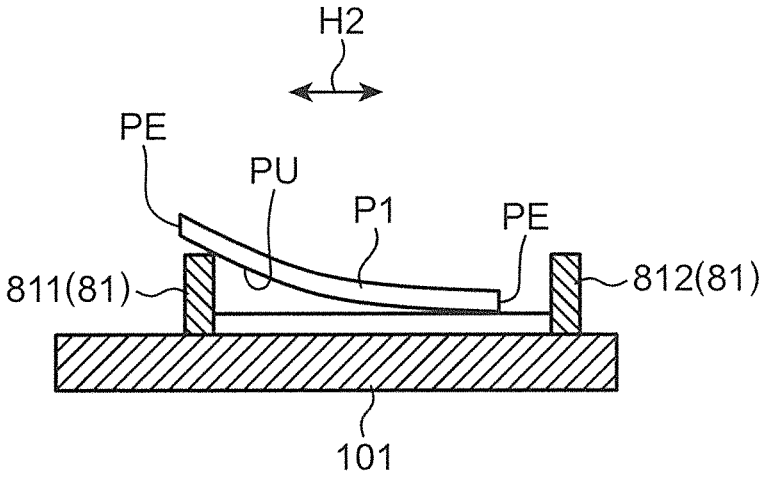
FIGS. 7A to 7C are schematic diagrams for describing the moving operation of the first cursors with respect to the processing tray, and are cross-sectional views taken along a sheet width direction.
Figure 7B:
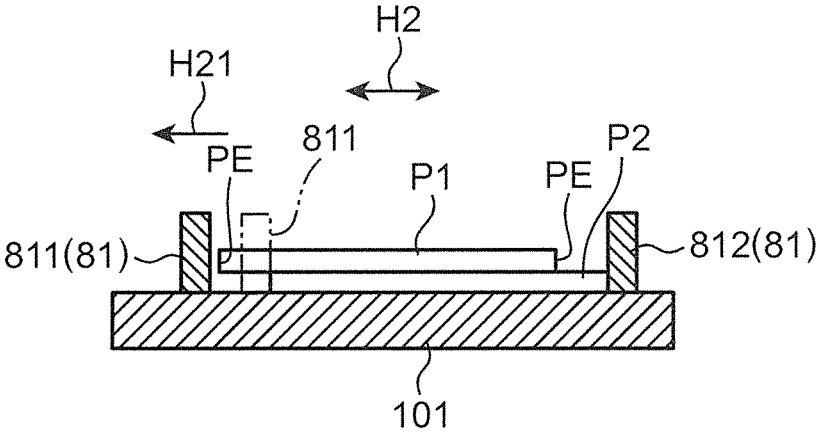
Figure 7C:
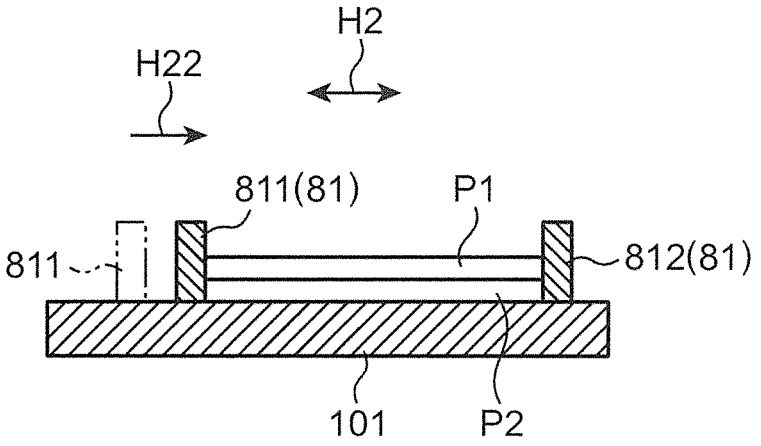

Description is provided of the sheet supporting processing, the sheet support cancelling processing, and the widthwise alignment processing mentioned above, with reference to FIGS. 6A to 6C and FIGS. 7A to 7C. FIGS. 6A to 6C are schematic diagrams for describing a moving operation of the first cursors 81 with respect to the processing tray 101, and are plan views when seen from above. FIGS. 7A to 7C are schematic diagrams for describing the moving operation, and are cross-sectional views taken along the sheet width direction H2.

The present embodiment is configured so that the center of a sheet transported in the sheet transport direction H11 by the first discharge roller pair 72 or sent out in the direction H12 opposite the sheet transport direction H11 by the paddle unit 74 before being placed on the processing tray 101 and the center of the sheet when the sheet has been placed on the processing tray 101 and is to undergo the widthwise alignment processing by the pair of first cursors 81 have different positions in the sheet width direction H2. That is, the sheet receives the widthwise alignment processing by the pair of first cursors 81 after being moved in the sheet width direction H2. This process is as follows when described in detailed with reference to FIGS. 6A to 7C. Note that in FIGS. 6A to 7C, a sheet before being placed on the processing tray 101 that is being transported in the sheet transport direction H11 by the first discharge roller pair 72 and a sheet before being placed on the processing tray 101 that is being sent out in the direction H12 opposite the sheet transport direction H11 by the paddle unit 74 are illustrated as "sheet P1," and a sheet already stacked on the processing tray 101 is illustrated as "sheet P2".

In the first cursor moving processing, the control unit 200 executes the sheet supporting processing before a leading end PS of a sheet P1 transported by the first discharge roller pair 72 reaches the top surface of the processing tray 101. The timing when the control unit 200 executes the sheet supporting processing is, for example, the timing when the first sheet discharge sensing sensor S1 detects that the leading end PS of the sheet P1 has entered the first discharge roller pair 72. In the sheet supporting processing, the control unit 200 controls the operation of the first moving unit 91 and thereby positions at least one of the pair of first cursors 81 at a sheet supporting position below the sheet P1 transported by the first discharge roller pair 72 (see FIGS. 6A and 7A). A first cursor 81 positioned at the sheet supporting position contacts a bottom surface PU of the sheet P1 and becomes capable of supporting the sheet P1 from below. Hence, it is possible to prevent, as much as possible, a situation in which the sheet P1 transported toward the processing tray 101 by the first discharge roller pair 72 pushes out a sheet P2 already placed on the processing tray 101.

In the example illustrated in FIGS. 6A and 7A, the control unit 200 controls the operation of the first moving unit 91 and thereby positions a first cursor 811, which is one of the pair of first cursors 81, at the sheet supporting position below the sheet P1 transported by the first discharge roller pair 72 and positions a first cursor 812, which is the other one of the pair of first cursors 81, at a lateral end surface contacting position at which the first cursor 812 is capable of contacting a lateral end surface PE (the lateral end surface at the other side in the sheet width direction H2) of the sheet P2 placed on the processing tray 101. Note that the sheet supporting position at which the first cursor 811 is positioned is set to a position at which the first cursor 811 is capable of contacting a lateral end surface PE (the lateral end surface at one side in the sheet width direction H2) of the sheet P2 placed on the processing tray 101. In this case, the sheet P1 can be supported from below by the first cursor 811, which is the one of the pair of first cursors 81 that is arranged at the sheet supporting position.

Next, the control unit 200 executes the sheet support cancelling processing when the leading end PS of the sheet P1 transported by the first discharge roller pair 72 passes a predetermined position of the processing tray 101 during the sheet supporting processing. The timing when the control unit 200 executes the sheet support cancelling processing is, for example, the timing when the leading end PS of the sheet P1 passes the downstream-side end edge of the processing tray 101 and the first sheet discharge sensing sensor S1 detects that the trailing end PB of the sheet P1 has passed through the first discharge roller pair 72. In the sheet support cancelling processing, the control unit 200 controls the operation of the first moving unit 91 and thereby positions, at a sheet support cancelling position, a first cursor 81 positioned at the sheet supporting position (see FIGS. 6B and 7B). A first cursor 81, when positioned at the sheet support cancelling position, is located further outward than a lateral end surface PE of the sheet P1 is, and supporting of the sheet P1 from below is cancelled. Hence, the sheet P1 transported by the first discharge roller pair 72 toward the processing tray 101 is placed on the processing tray 101.

In the example illustrated in FIGS. 6B and 7B, the control unit 200 controls the operation of the first moving unit 91 and thereby moves the first cursor 811, which is one of the pair of first cursors 81, from the sheet supporting position to the sheet support cancelling position (moves the first cursor 811 in the direction of arrow H21), and maintains the positioning of the first cursor 812, which is the other one of the pair of first cursors 81, at the lateral end surface contacting position. That is, only the first cursor 811, which is one of the pair of first cursors 81, is moved when cancelling the support of the sheet P1 by the first cursors 81 and placing the sheet P1 on the processing tray 101.

By the timing when the control unit 200 executes the sheet support cancelling processing, the control unit 200, by drive control of the nip release drive unit 112, has caused the nip release mechanism 76 to release the second nip part 73N of the second discharge roller pair 73. Further, at this timing, the control unit 200 controls the draw-in drive unit 111 so that the hitting member 751 hits the trailing end PB of the sheet P1 from up to down to cause the sheet P1 to fall onto the processing tray 101 and so that the draw-in operation of the sheet P1 by the paddle unit 74 is executed and the sheet P1 is sent out in the direction H12 opposite the sheet transport direction H11 (see FIGS. 6B and 7B). By the paddle unit 74 performing the draw-in operation of the sheet P1, the sheet P1 is transported to the position at which the trailing end PB thereof contacts the receiving plate 102. Note that in a state in which the sheet P1 has been transported to the position on the processing tray 101 at which the trailing end PB of the sheet P1 contacts the receiving plate 102 immediately after the execution of the sheet support cancelling processing by the control unit 200, the center of the sheet P1 and the center of the sheet P2 already placed on the processing tray 101 still have different positions in the sheet width direction H2.

Hence, next, the control unit 200 controls the operation of the first moving unit 91 and thereby executes the widthwise alignment processing by the pair of first cursors 81, with respect to the sheets P1 and P2 stacked on the processing tray 101 (see FIGS. 6C and 7C). In the widthwise alignment processing, the first cursors 81 forming a pair contact the lateral end surfaces PE in the sheet width direction H2 of the sheets P1 and P2 stacked on the processing tray 101 and thereby correct skewing of the sheets and perform widthwise alignment of the sheets. Hence, skewing of the sheets P1 and P2 is corrected on the processing tray 101 and widthwise alignment of the sheets P1 and P2 is performed on the processing tray 101, and thus, staple processing by the staple processing unit 62 can be performed appropriately with respect to the sheets.

In the example illustrated in FIGS. 6C and 7C, the control unit 200 operates the first moving unit 91 so that the first cursor 811, which is the one of the pair of first cursors 81 positioned at the sheet support cancelling position, moves in a direction H22 towards the first cursor 812, which is the other one of the pair of first cursors 81 that is positioned at the lateral end surface contacting position. Hence, the first cursors 81 forming a pair contact the lateral end surfaces PE in the sheet width direction H2 of the sheets P1 and P2 stacked on the processing tray 101, and skewing of the sheets can be corrected and widthwise alignment of the sheets can be performed.

<Regarding Movement Control, by Control Unit, of Second Cursors with Respect to Stacking Tray>

The control unit 200 controls the drive of the second moving unit 92 and thereby controls the moving operation and the swinging operation of the pair of second cursors 82 with respect to the stacking tray 103. The control unit 200 operates the second moving unit 92 so that the second cursors 82 forming a pair move and swing with respect to the stacking tray 103 when sheets having undergone at least one type of post-processing among the hole punch processing by the hole punch processing unit 61 and the staple processing by the staple processing unit 62 are discharged onto the stacking tray 103 by the second discharge roller pair 73.

The stacking tray 103 is a tray that becomes the final discharge location of sheets in the sheet post-processing device 5. Sheets having been stacked on the stacking tray 103 are removed from the stacking tray 103 by users. It is beneficial to maintain good alignment of sheets stacked on the stacking tray 103 in order to achieve good removability of sheets from the stacking tray 103 by users.

Figure 8A:
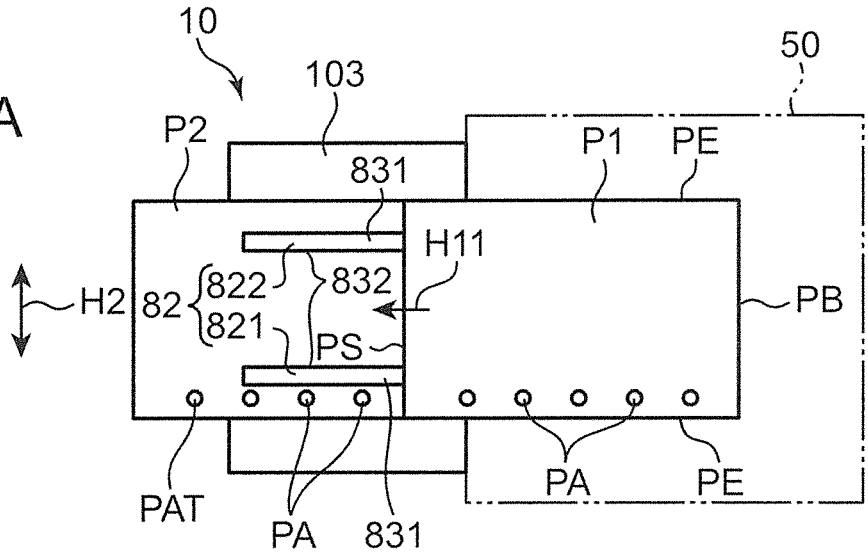
FIGS. 8A to 8C are schematic diagrams for describing a first moving operation of second cursors with respect to a stacking tray of the sheet stacking device, and are plan views when seen from above.
Figure 8B:
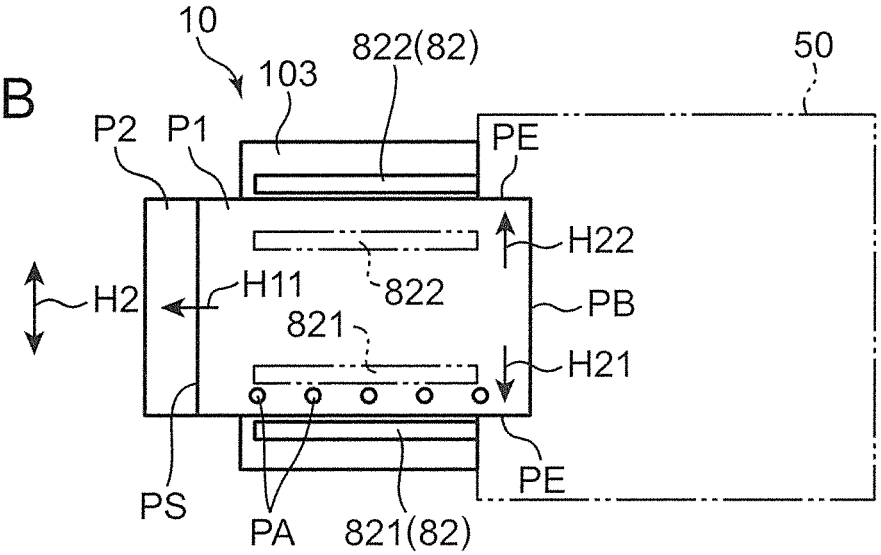
Figure 8C:
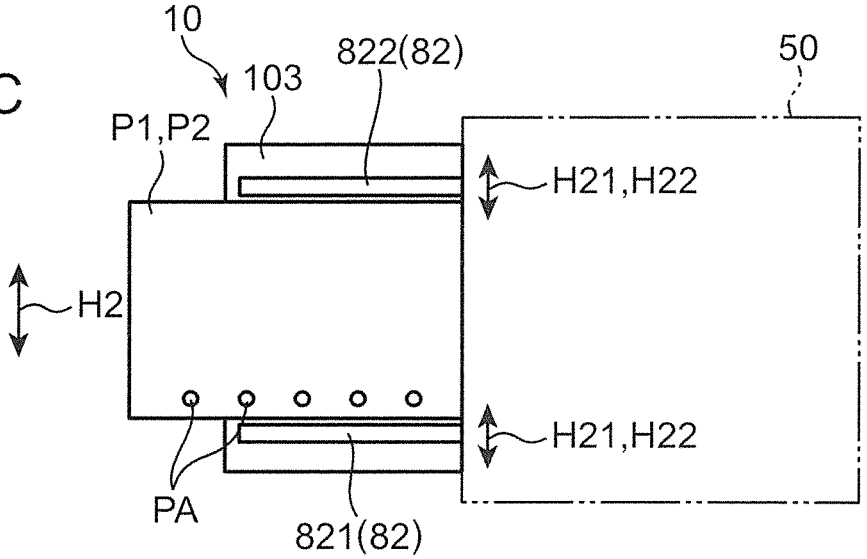
Figure 9A:
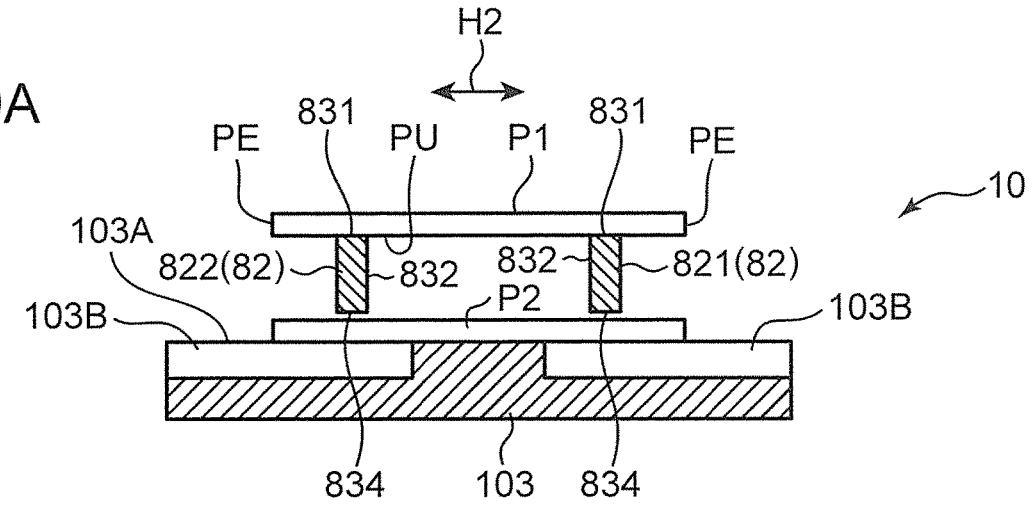
FIGS. 9A to 9C are schematic diagrams for describing the first moving operation of the second cursors with respect to the stacking tray of the sheet stacking device, and are cross-sectional views taken along the sheet width direction.
Figure 9B:
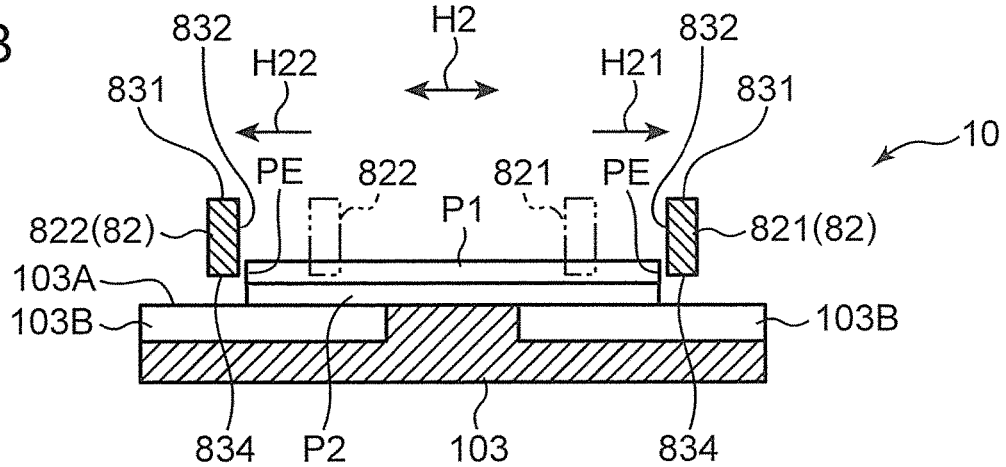
Figure 9C:
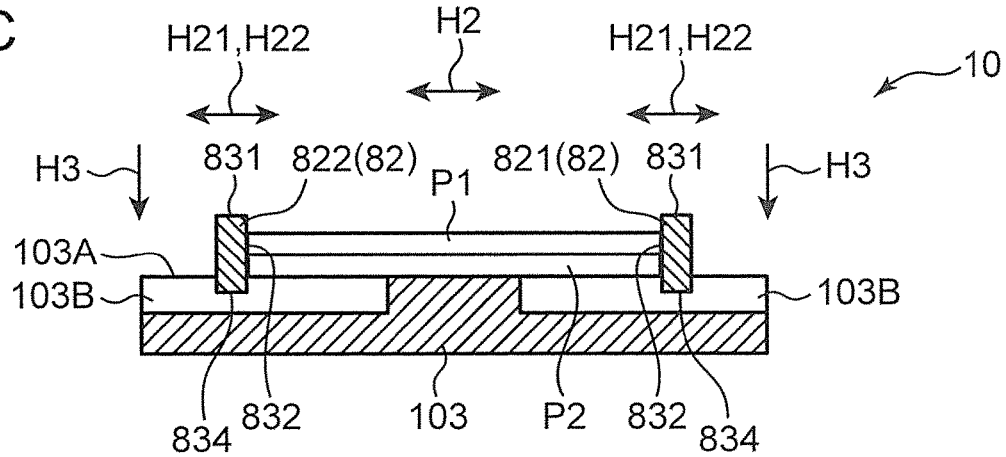

Hence, the control unit 200 controls the operation of the second moving unit 92 and thereby executes second cursor moving processing in which the second cursors 82 forming a pair are moved with respect to the stacking tray 103. As the second cursor moving processing, the control unit 200 executes sheet guiding processing and widthwise alignment processing. Description is provided of the sheet guiding processing and the widthwise alignment processing mentioned above, with reference to FIGS. 8A to 9C. FIGS. 8A to 8C are schematic diagrams for describing a first moving operation of the second cursors 82 with respect to the stacking tray 103 of the sheet stacking device 10, and are plan views when seen from above. FIGS. 9A to 9C are schematic diagrams for describing the first moving operation, and are cross-sectional views taken along the sheet width direction H2. Note that in FIGS. 8A to 9C, a sheet before being placed on the stacking tray 103 that is being discharged in the sheet transport direction H11 (the sheet discharge direction) by the second discharge roller pair 73 is illustrated as "sheet P1," and a sheet already placed on the stacking tray 103 is illustrated as "sheet P2". Further, FIGS. 8A to 9C illustrate control performed by the control unit 200 in a case in which a sheet P1 having undergone the hole punch processing by the hole punch processing unit 61 is discharged onto the stacking tray 103 by the second discharge roller pair 73.

The control unit 200 executes the sheet guiding processing before a leading end PS of the sheet P1 discharged by the second discharge roller pair 73 reaches the sheet stacking surface 103A at the top surface of the stacking tray 103. The timing when the control unit 200 executes the sheet guiding processing is, for example, the timing when the second sheet discharge sensing sensor S2 detects that the leading end PS of the sheet P1 has entered the second discharge roller pair 73.

The control unit 200 controls the operation of the second moving unit 92 and thereby positions at least one of the pair of second cursors 82 at a sheet guiding position below the sheet P1 discharged by the second discharge roller pair 73 (a position further inward in the sheet width direction H2 than a lateral end surface of the sheet P1 is) (see FIGS. 8A and 9A). Note that as already described above, the stacking tray 103 is lowered in response to sheet discharge by the second discharge roller pair 73. Due to this, a second cursor 82 positioned at the sheet guiding position is located above a sheet P2 already placed on the stacking tray 103. Further, the bottom surfaces 834 of the tip parts 82E1 of the second cursors 82 forming a pair are arranged at the second position above the sheet stacking surface 103A of the stacking tray 103.

A second cursor 82 positioned at the sheet guiding position contacts a bottom surface PU of the sheet P1 and becomes capable of guiding the sheet P1 toward the sheet transport direction H11. Hence, even in a state in which a sheet P2 having binding holes PA (processing traces) formed along a lateral end edge of the sheet P2 is already placed on the stacking tray 103, the sheet P1 discharged by the second discharge roller pair 73 toward the stacking tray 103 can be guided toward the sheet transport direction H11 while avoiding interference with the binding holes PA in the sheet P2 already placed on the stacking tray 103. Due to this, it is possible to avoid, as much as possible, a situation in which the leading end PS of the sheet P1 is caught by the binding holes PA in the sheet P2 already placed on the stacking tray 103.

In the example illustrated in FIGS. 8A and 9A, the control unit 200 operates the second moving unit 92 so that the second cursors 82 forming a pair are each positioned at the sheet guiding position. Specifically, the control unit 200 operates the second moving unit 92 so that a guide surface (top surface) of a top surface part 831 of a second cursor 821, which is one of the pair of second cursors 82 forming a pair that is located at one side in the sheet width direction, is positioned at the sheet guiding position, at which the guide surface contacts an area of the bottom surface PU of the sheet P1 that is further inward in the sheet width direction H2 than the binding holes PA are. Further, the control unit 200 operates the second moving unit 92 so that the guide surface of the top surface part 831 of a second cursor 822 located at the other side is positioned at the sheet guiding position, at which the guide surface contacts the bottom surface PU of the sheet P1. In this case, it is possible to guide the sheet P1, which is discharged toward the stacking tray 103 by the second discharge roller pair 73, toward the sheet transport direction H11 while avoiding interference with the binding holes PA in the sheet P2 already placed on the stacking tray 103.

Next, when the leading end PS of the sheet P1 passes a predetermined position above the second cursors 82, the control unit 200 controls the operation of the second moving unit 92 and positions the second cursors 82, which are positioned at the sheet guiding position, at a retracted position that is further outward in the sheet width direction H2 than lateral end surfaces PE of the sheet P1 are (see FIG. 8B and FIG. 9B). Hence, the guiding by the second cursors 82 of the sheet P1, which is discharged in the sheet transport direction H11 by the second discharge roller pair 73, is cancelled.

Note that at the timing at which the control unit 200 positions the second cursors 82 at the retracted position, the stacking tray 103 is lowered in response to sheet discharge by the second discharge roller pair 73. Due to this, the second cursors 82 arranged at the retracted position are located at positions facing the lateral end surfaces PE of the sheet P1, which is positioned highest on the stacking tray 103. As a result, the bottom surfaces 834 of the tip parts 82E1 of the second cursors 82 forming a pair are positioned at the second position, which is above the sheet stacking surface 103A of the stacking tray 103.

In the example illustrated in FIGS. 8B and 9B, the control unit 200 operates the second moving unit 92 so that each of the second cursors 82 forming a pair, which are positioned at the sheet guiding position, moves to the retracted position. Specifically, the control unit 200 operates the second moving unit 92 so that the second cursor 821, which is located at the one side in the sheet width direction, moves from the sheet guiding position to the retracted position (moves in the direction of arrow H21) and the second cursor 822, which is located at the other side in the sheet width direction, moves from the sheet guiding position to the retracted position (moves in the direction of arrow H22 opposite the arrow H21). Hence, the guiding by the second cursors 82 forming a pair of the sheet P1, which is discharged in the sheet transport direction H11, is cancelled.

Further, the timing at which each of the second cursors 82 forming a pair is moved from the sheet guiding position to the retracted position and the guiding of the sheet P1 by the pair of second cursors 82 is cancelled is set at the timing when the leading end PS of the later-discharged sheet P1 (second sheet) discharged by the second discharge roller pair 73 passes the most-downstream binding hole PAT in the earlier-discharged sheet P2 (first sheet) placed on the stacking tray 103. Due to this, the sheet P1 is guided by the pair of second cursors 82 until the leading end PS of the sheet P1 passes the most-downstream binding hole PAT in the sheet P2 placed on the stacking tray 103. Hence, it is possible to avoid, as much as possible, a situation in which the leading end PS of the sheet P1 is caught by the binding holes PA formed along a lateral end edge of the sheet P2 placed on the stacking tray 103.

Next, when the trailing end PB of the sheet P1 passes through the second discharge roller pair 73 and the sheet P1 is placed on the stacking tray 103, the control unit 200 controls the operation of the second moving unit 92 and thereby executes the widthwise alignment processing by the pair of second cursors 82 (see FIGS. 8C and 9C). In the widthwise alignment processing, the second cursors 82 forming a pair contact the lateral end surfaces PE in the sheet width direction H2 of the sheets P1 and P2 stacked on the stacking tray 103 and thereby correct skewing of the sheets and perform widthwise alignment of the sheets. Hence, it is possible to maintain good alignment of the sheets P1 and P2 stacked on the stacking tray 103, and good removability of sheets from the stacking tray 103 by users can be achieved.

In the example illustrated in FIGS. 8C and 9C, the control unit 200 causes the bottom surfaces 834 of the tip parts 82E1 of the second cursors 82 forming a pair, which are positioned at the second position to face the lateral end surfaces of the sheet P1 positioned highest on the stacking tray 103, to swing down (to swing in the direction of arrow H3) so that the tip parts 82E1 are positioned at the first position, at which the tip parts 82E1 contact the bottom surface parts of the recess parts 103B formed in the sheet stacking surface 103A. Further, the control unit 200 causes the lateral surface parts 832 of the second cursors 82 forming a pair to move in the directions of the arrows H21 and H22 along the sheet width direction H2, so that the lateral surface parts 832 contact the lateral end surfaces PE in the sheet width direction H2 of the sheets P1 and P2 stacked on the stacking tray 103. Hence, the second cursors 82 forming a pair contact the lateral end surfaces PE in the sheet width direction H2 of the sheets P1 and P2 stacked on the stacking tray 103, and widthwise alignment of the sheets can be performed.

Figure 10A:
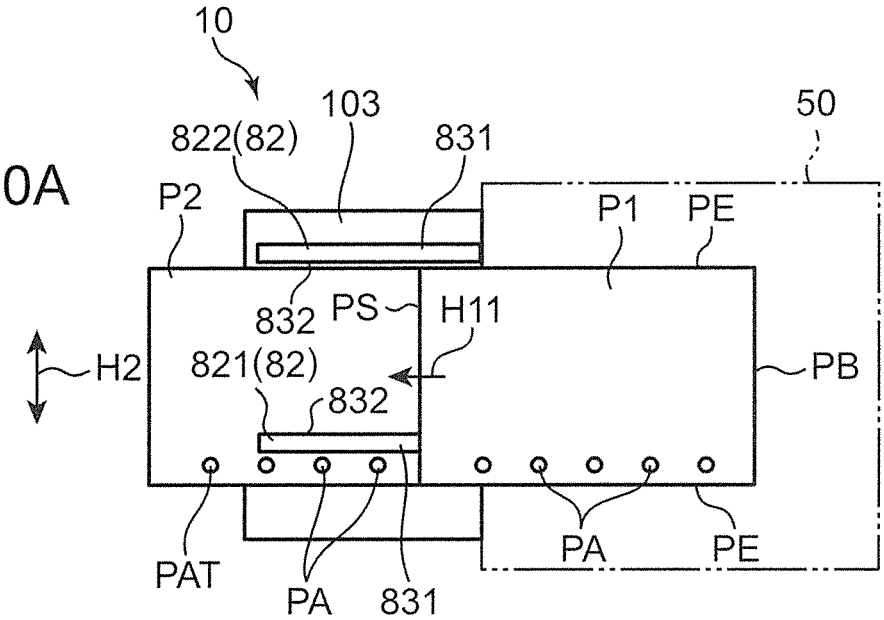
FIGS. 10A to 10C are schematic diagrams for describing a second moving operation of the second cursors with respect to the stacking tray of the sheet stacking device, and are plan views when seen from above.
Figure 10B:
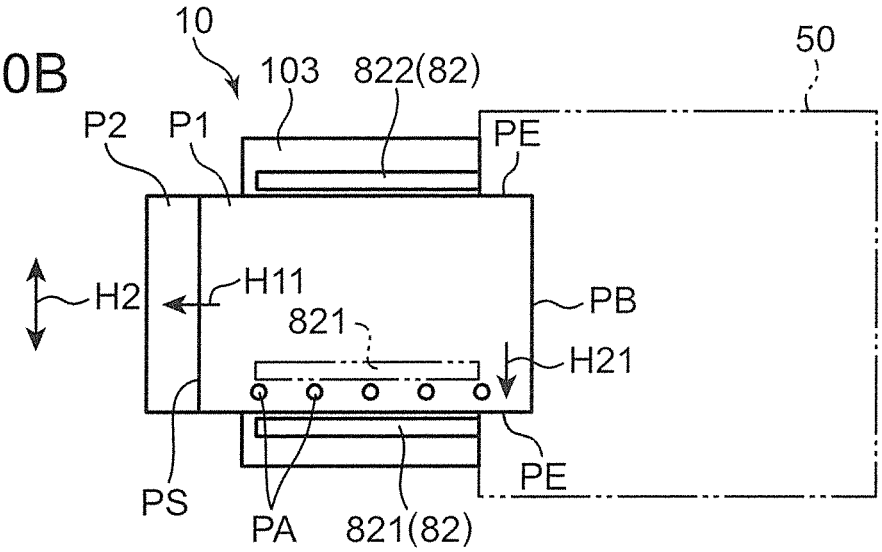
Figure 10C:
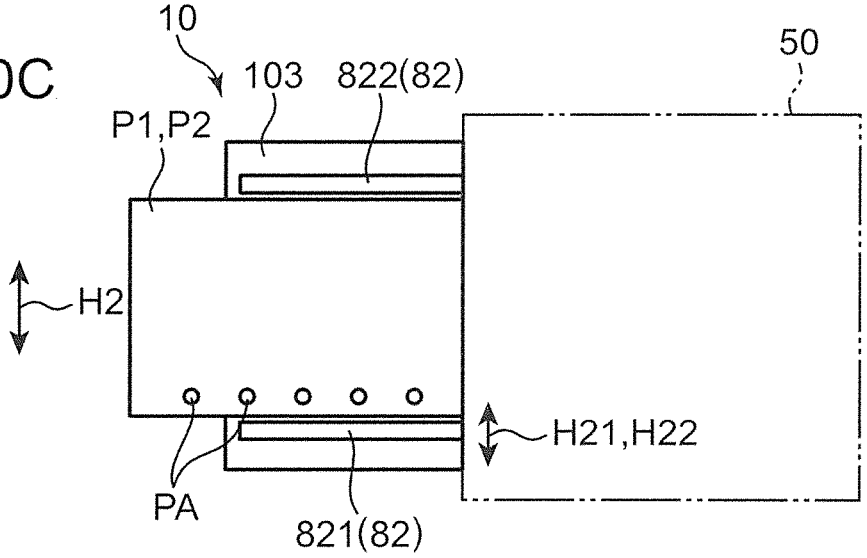
Figure 11A:
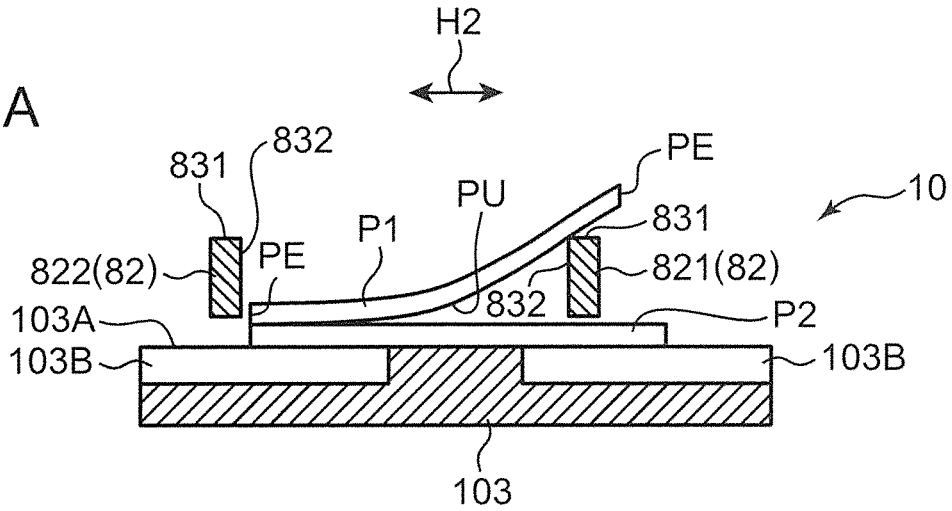
FIGS. 11A to 11C are schematic diagrams for describing the second moving operation of the second cursors with respect to the stacking tray of the sheet stacking device, and are cross-sectional views taken along the sheet width direction.
Figure 11B:
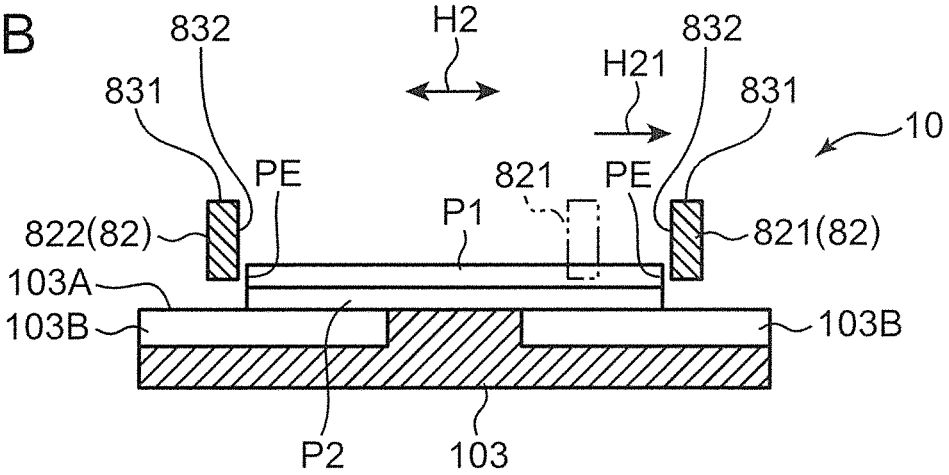
Figure 11C:
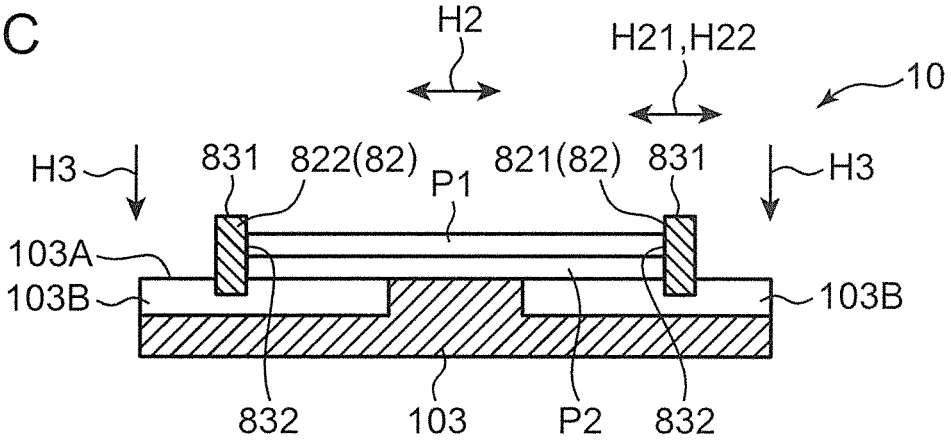

Further, the control unit 200 may be configured to control the drive of the second moving unit 92 so that the moving operation of the pair of second cursors 82 is as illustrated in FIGS. 10A to 11C. FIGS. 10A to 10C are schematic diagrams for describing a second moving operation of the second cursors 82 with respect to the stacking tray 103 of the sheet stacking device 10, and are plan views when seen from above. FIGS. 11A to 11C are schematic diagrams for describing the second moving operation, and are cross-sectional views taken along the sheet width direction H2. Note that in FIGS. 10A to 11C, a sheet before being placed on the stacking tray 103 that is being discharged in the sheet transport direction H11 by the second discharge roller pair 73 is illustrated as "sheet P1", and a sheet already placed on the stacking tray 103 is illustrated as "sheet P2".

In the example illustrated in FIGS. 10A and 11A, the control unit 200 executes the sheet guiding processing before a leading end PS of the sheet P1 discharged by the second discharge roller pair 73 reaches the sheet stacking surface 103A of the top surface of the stacking tray 103. The timing when the control unit 200 executes the sheet guiding processing is, for example, the timing when the second sheet discharge sensing sensor S2 detects that the leading end PS of the sheet P1 has entered the second discharge roller pair 73. In the sheet guiding processing, the control unit 200 controls the operation of the second moving unit 92 and thereby positions a second cursor 821, which is one of the pair of second cursors 82 located at one side in the sheet width direction, at the sheet guiding position below the sheet P1 discharged by the second discharge roller pair 73, and positions a second cursor 822, which is the other one of the pair of second cursors 82 that is located at the other side in the sheet width direction, at the lateral end surface contacting position, at which the second cursor 822 is capable of contacting a lateral end surface PE of the sheet P1.

Specifically, the control unit 200 operates the second moving unit 92 so that the guide surface (top surface) of the top surface part 831 of the second cursor 821 located at the one side is positioned at the sheet guiding position, at which the guide surface contacts an area of the bottom surface PU of the sheet P1 that is further inward in the sheet width direction H2 than the binding holes PA are. Further, the control unit 200 operates the second moving unit 92 so that the lateral surface part 832 of the second cursor 822 located at the other side is positioned at the lateral end surface contacting position, at which the lateral surface part 832 is capable of contacting a lateral end surface PE of the sheet P1 (the lateral end surface at the other side in the sheet width direction H2). In this case, it is possible to guide the sheet P1, which is discharged toward the stacking tray 103 by the second discharge roller pair 73, toward the sheet transport direction H11 while avoiding interference with the binding holes PA in the sheet P2 already placed on the stacking tray 103.

Next, when the leading end PS of the sheet P1 passes a predetermined position above the second cursors 82 during the sheet guiding processing, the control unit 200 controls the operation of the second moving unit 92 and thereby moves the second cursor 821 located at the one side from the sheet guiding position to the retracted position, which is further outward than a lateral end surface PE of the sheet P1 is (moves the second cursor 821 in the direction of arrow H21), and maintains the positioning of the second cursor 822 located at the other side at the lateral end surface contacting position (see FIGS. 10B and 11B). Hence, the guiding of the sheet P1, which is discharged in the sheet transport direction H11 (the sheet discharge direction) by the second discharge roller pair 73, by the second cursor 821 located at the one side in the sheet width direction is cancelled.

Note that at the timing at which the control unit 200 positions the second cursors 821 located at the one side in the sheet width direction at the retracted position, the stacking tray 103 is lowered in response to sheet discharge by the second discharge roller pair 73. Due to this, the second cursors 82 forming a pair are located at positions facing the lateral end surfaces PE of the sheet P1, which is positioned highest on the stacking tray 103. As a result, the bottom surfaces 834 of the tip parts 82E1 of the second cursors 82 forming a pair are positioned at the second position, which is above the sheet stacking surface 103A of the stacking tray 103.

Further, the timing at which the second cursor 821, which is the one of the pair of second cursors 82 that is located at the one side, is moved from the sheet guiding position to the retracted position and the guiding of the sheet P1 by the second cursors 82 is cancelled is set at the timing when the leading end PS of the sheet P1 discharged by the second discharge roller pair 73 passes the most-downstream binding hole PAT in the sheet P2 placed on the stacking tray 103. Due to this, the sheet P1 is guided by the second cursor 821 located at the one side until the leading end PS of the sheet P1 passes the most-downstream binding hole PAT in the sheet P2 placed on the stacking tray 103. Hence, it is possible to avoid, as much as possible, a situation in which the leading end PS of the sheet P1 is caught by the binding holes PA formed along a lateral end edge of the sheet P2 placed on the stacking tray 103.

Next, when the trailing end PB of the sheet P1 passes through the second discharge roller pair 73 and the sheet P1 is placed on the stacking tray 103, the control unit 200 controls the operation of the second moving unit 92 and thereby executes the widthwise alignment processing by the pair of second cursors 82 (see FIGS. 10C and 11C). Specifically, the control unit 200 causes the bottom surfaces 834 of the second cursors 82 forming a pair, which are positioned at the second position to face the lateral end surfaces of the sheet P1 positioned highest on the stacking tray 103, to swing downward (to swing in the direction of arrow H3) so that the tip parts 82E1 are positioned at the first position, at which the tip parts 82E1 contact the bottom surface parts of the recess parts 103B formed in the sheet stacking surface 103A. Further, the control unit 200 causes the lateral surface parts 832 of the second cursors 82 forming a pair to move in the directions of the arrows H21 and H22 along the sheet width direction H2, so that the lateral surface parts 832 contact the lateral end surfaces PE in the sheet width direction H2 of the sheets P1 and P2 stacked on the stacking tray 103. Hence, the second cursors 82 forming a pair contact the lateral end surfaces PE in the sheet width direction H2 of the sheets P1 and P2 stacked on the stacking tray 103, and widthwise alignment of the sheets can be performed.

Up to this point, detailed description has been provided of one embodiment of the present invention. However, the present disclosure is not limited to this. For example, the present disclosure can adopt modified embodiments as described in the following.

Figure 12:
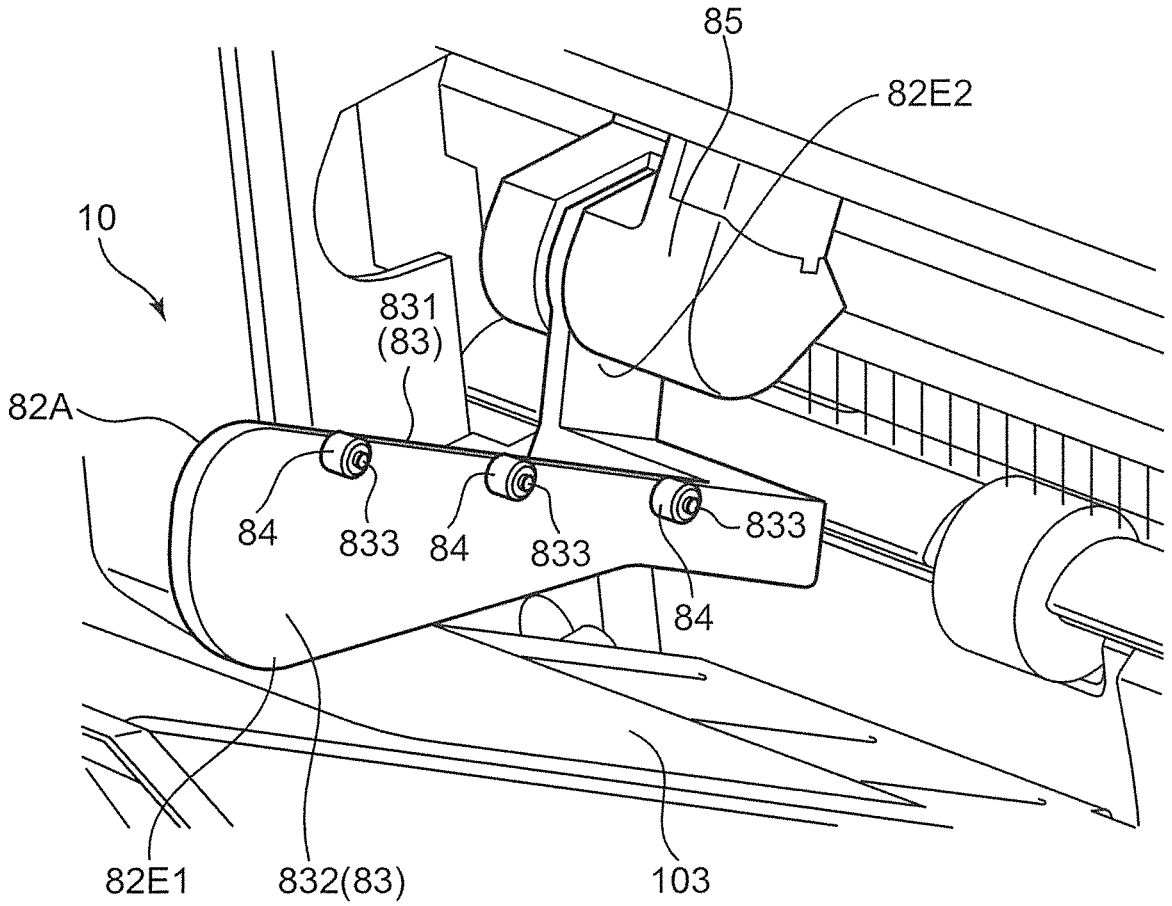
FIG. 12 is a perspective view illustrating a first modification of the second cursors.
Figure 13:
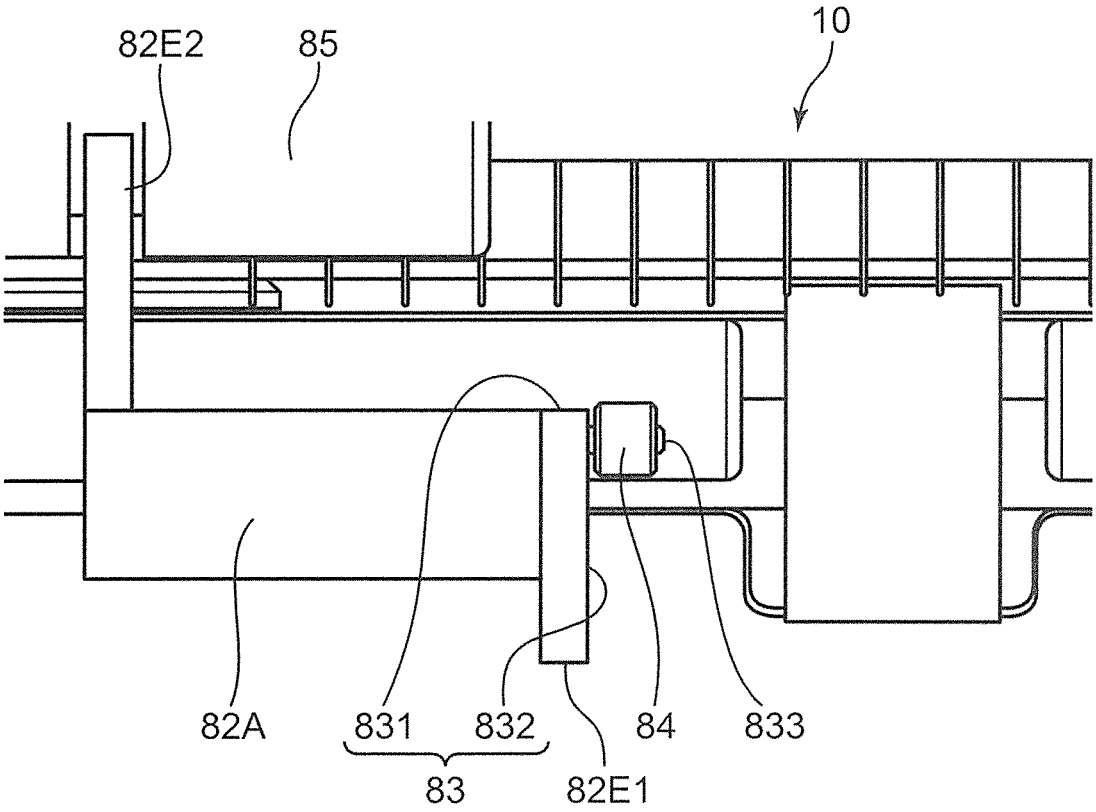
FIG. 13 is a diagram in which the second cursors in FIG. 12 are viewed from a sheet transport direction.
Figure 14:
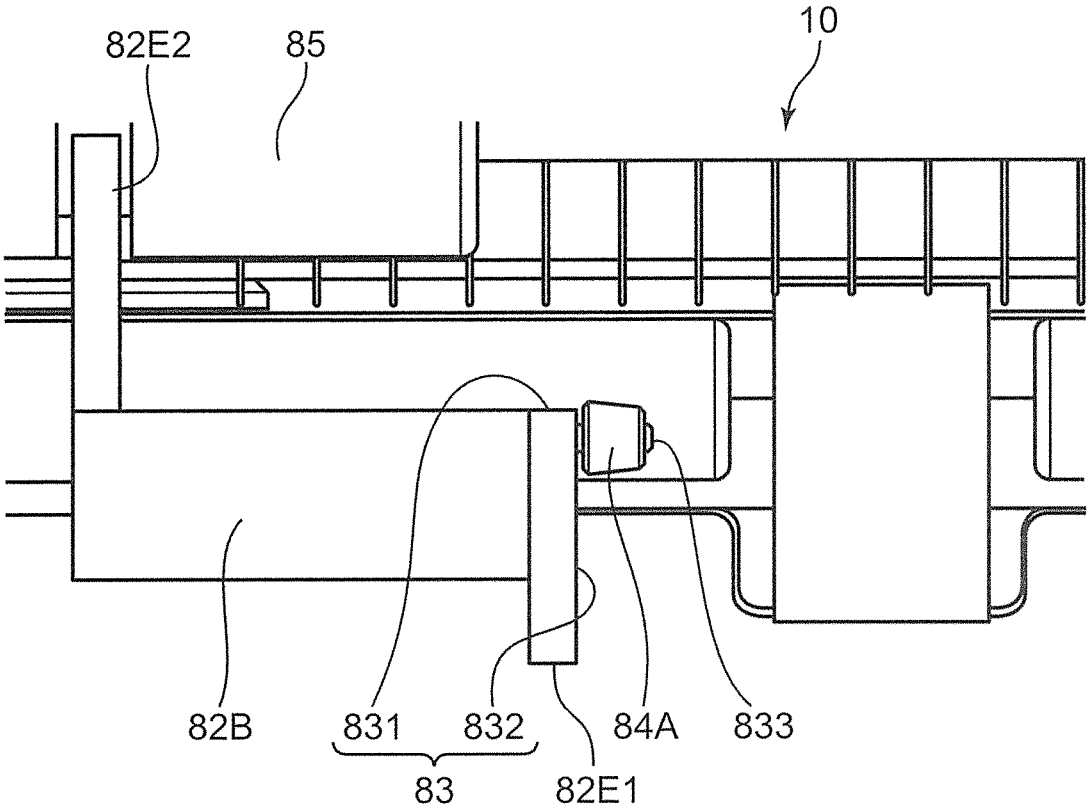
FIG. 14 is a diagram illustrating a second modification of the second cursors, when viewed from the sheet transport direction.

The pair of second cursors, which perform the widthwise alignment processing with respect to sheets stacked on the stacking tray 103, may be have the configurations illustrated in FIGS. 12 to 14. FIGS. 12 and 13 are diagrams illustrating a second cursor 82A of a first modification. FIG. 12 is a perspective view and FIG. 13 is a diagram when viewed from the sheet transport direction. FIG. 14 is a diagram illustrating a second cursor 82B of a second modification, when viewed from the sheet transport direction. Note that in FIGS. 12 to 14, illustration is provided of only one second cursor among second cursors forming a pair, and illustration of the other second cursor is omitted.

First, description is provided of the second cursors 82A of the first modification, with reference to FIGS. 12 and 13. Similarly to the second cursors 82, the second cursors 82A forming a pair are supported by the holders 85. The holders 85 are capable of moving along the sheet width direction H2, and support the second cursors 82A forming a pair to be rotatable about the base end parts 82E2 of the second cursors 82A so that the tip parts 82E1 of the second cursors 82A are swingable up and down. The second cursors 82A forming a pair move in the sheet width direction H2 accompanying the movement of the holders 85 along the sheet width direction H2, and the tip parts 82E1 of the second cursors 82A forming a pair swing up and down with the holders 85 serving as fulcrums.

The second cursors 82A forming a pair each include: a cursor main body 83; and one or more guide rollers 84. The cursor main body 83 has the top surface part 831, which supports bottom surfaces of sheets in response to the sheet guiding processing by the control unit 200 and the lateral surface part 832, which contacts lateral end surfaces of sheets in response to the widthwise alignment processing by the control unit 200. The guide rollers 84 are provided to the guide surface (the top surface) of the top surface part 831 of the cursor main body 83, and are supported by the lateral surface part 832 of the cursor main body 83 to be rotatable about shafts 833 that extend inward from a side surface of the cursor main body 83 in the sheet width direction H2. The number of guide rollers 84 provided may be one or two or more. Each guide roller 84 is formed to have a cylindrical shape, and a part of the outer circumferential surface thereof projects upward from the top surface part 831 of the cursor main body 83.

When the second discharge roller pair 73 discharges a sheet the bottom surface of which is guided by the guide surface (top surface) of the top surface part 831 in response to the sheet guiding processing by the control unit 200, the guide rollers 84 rotate about the shafts 833 in response to the discharge of the sheet. Hence, when sheets are discharged by the second discharge roller pair 73, the friction between the top surface part 831 of the cursor main body 83 and the bottom surfaces of the sheets can be reduced. Due to this, the guide rollers 84 are capable of smoothly guiding the discharge of sheets by the second discharge roller pair 73.

The guide rollers 84 provided to the second cursors 82A of the first modification are formed to have a cylindrical shape. By contrast, guide rollers 84A provided to second cursors 82B of the second modification illustrated in FIG. 14 have a cone shape or a truncated cone shape tapered toward the inner side in the sheet width direction H2. When sheets are discharged by the second discharge roller pair 73, the guide rollers 84A formed to have a cone shape or a truncated cone shape are capable of effectively reducing the friction between the top surface part 831 of the cursor main body 83 and the bottom surfaces of the sheets, similarly to the cylindrical guide rollers 84.

Meanwhile, when a second cursor 82B is moved along the sheet width direction H2 from the sheet guiding position to the retracted position in order to cancel the guiding of sheets by the second cursor 82B, sheets would fall toward the stacking tray 103 while contacting the guide rollers 84A. In a case in which the guide rollers 84A of the second cursor 82B are formed to have a cone shape or a truncated cone shape tapered toward the inner side in the sheet width direction H2, sheets would fall toward the stacking tray 103 along the slopes of the tapered guide rollers 84A. Thus, it can be ensured that the sheets fall smoothly onto the stacking tray 103.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet stacking device comprising:

a sheet discharge unit that discharges a sheet;

a sheet stacking unit that includes a tray which accepts the sheet discharged by the sheet discharge unit and on which the sheet is placed;

a pair of cursors that performs, with respect to the sheet placed on the tray, widthwise alignment processing in which the cursors contact lateral end surfaces of the sheet in a sheet width direction perpendicular to a sheet discharge direction to perform widthwise alignment; and a control unit, wherein each of the cursors in the pair of cursors includes a cursor main body that has a plate-shape and contacts a lateral end surface of the sheet and a guide surface that is provided at a top surface of the cursor main body, the control unit, before a leading end of the sheet discharged by the sheet discharge unit reaches a sheet stacking surface at a top surface of the tray, executes sheet guiding processing in which at least one of the pair of cursors is positioned at a sheet guiding position that is farther inward in the sheet width direction than a lateral end surface of the sheet is, to make the guide surface contact a bottom surface of the sheet and guide the sheet toward the sheet discharge direction, the control unit, when the leading end of the sheet discharged by the sheet discharge unit passes a predetermined position above the at least one cursor during the sheet guiding processing, positions the at least one cursor positioned at the sheet guiding position at a retracted position that is farther outward in the sheet width direction than the lateral end surface of the sheet is, and the control unit, once a trailing end of the sheet discharged by the sheet discharge unit passes through the sheet discharge unit and the sheet is placed on the tray, executes the widthwise alignment processing by the pair of cursors.

2. The sheet stacking device according to claim 1, wherein each of the cursors in the pair of cursors has a base end part that is located at an upstream side in the sheet discharge direction, the base end parts of the cursors are rotatably supported so that tip parts of the cursors in the sheet discharge direction are swingable between a first position where bottom surfaces of the tip parts are located below the sheet stacking surface and a second position where bottom surfaces of the tip parts are located above the sheet stacking surface, and the tip parts of the cursors are positioned at the first position during the widthwise alignment processing and are positioned at the second position during the sheet guiding processing.

3. The sheet stacking device according to claim 1, wherein each of the cursors in the pair of cursors includes:

a guide roller that is provided adjacent to an inner side of the guide surface in the sheet width direction and is supported to be rotatable about a shaft extending inward from a side surface of the cursor main body in the sheet width direction.

4. The sheet stacking device according to claim 3, wherein the guide roller has a cone shape or a truncated cone shape, the cone shape or the truncated cone shape being tapered inward in the sheet width direction.

5. A sheet post-processing device comprising:

a post-processing mechanism that performs predetermined post-processing with respect to a sheet; and the sheet stacking device according to claim 1, on which the sheet having undergone the post-processing by the post-processing mechanism is stacked.

6. The sheet post-processing device according to claim 5, wherein the post-processing mechanism includes a punching unit for punching binding holes in sheets, and in a case in which the sheets formed with the binding holes are discharged, the control unit moves the at least one of the pair of cursors from the sheet guiding position to the retracted position when, during the sheet guiding processing for a second sheet following a first sheet placed on the tray, a leading end of the second sheet passes the binding holes in the first sheet.

7. The sheet post-processing device according to claim 6, wherein in a case in which the binding holes are formed along a lateral end edge at one side in the sheet width direction, the control unit moves one of the pair of cursors that is located at the one side to the sheet guiding position to execute the sheet guiding processing.

8. An image forming device comprising:

an image forming unit that forms an image on a sheet; and the sheet post-processing device according to claim 5, that performs the post-processing on the sheet on which the image has been formed.

9. A sheet stacking device comprising:

a housing;

a sheet discharge unit that discharges a sheet;

a sheet stacking unit that includes a tray which accepts the sheet discharged by the sheet discharge unit and on which the sheet is placed;

a pair of cursors that performs, with respect to the sheet placed on the tray, widthwise alignment processing in which the pair of cursors contact lateral end surfaces of the sheet in a sheet width directions perpendicular to a sheet discharge direction to perform widthwise alignment; and a control unit, wherein each of the cursors in the pair of cursors further includes a cursor main body that has a plate-shape and contacts a lateral end surface of the sheet and a guide surface that is provided at a top surface of the cursor main body and a base end parts of the cursors that is located at an upstream side in the sheet discharge direction and is rotatably supported by the housing, the pair of cursors is movable in the sheet width directions and the pair of cursors is supported by the base end parts so that tip parts of the cursors in the sheet discharge direction are swingable between a first posture in which bottom surfaces of the tip parts are located below a sheet stacking surface that is a top surface of the tray and a second posture in which the bottom surfaces of the tip parts are located above the sheet stacking surface, the control unit, during discharge, by the sheet discharge unit, of the sheet onto the sheet stacking surface, switches a posture of at least one of the pair of cursors to the second posture to execute sheet guiding processing in which the at least one of the pair of cursors is positioned at a sheet guiding position that is inward in the sheet width directions of the sheet to make the guide surface contact a bottom surface of the sheet and guide the sheet toward the sheet discharge direction, and the control unit, when a leading end of the sheet discharged by the sheet discharge unit passes a predetermined position above the at least one of the pair of cursors during the sheet guiding processing, positions the at least one of the pair of cursors that is located at the sheet guiding position to a retracted position that is farther outward in the sheet width directions than a lateral end surface of the sheet and switches the posture of the at least one of the pair of cursors to the first posture to execute the widthwise alignment processing by the pair of cursors once the sheet is discharged and placed on the tray.

10. A sheet post-processing device comprising:

a post-processing mechanism that performs predetermined post-processing with respect to a sheet; and a sheet stacking device on which the sheet having undergone the post-processing by the post-processing mechanism is stacked, wherein the sheet stacking device includes:

a sheet discharge unit that discharges the sheet;

a sheet stacking unit that includes a tray that accepts the sheet discharged by the sheet discharge unit and on which the sheet is placed;

a pair of cursors that performs, with respect to the sheet placed on the tray, widthwise alignment processing in which the cursors contact lateral end surfaces of the sheet in a sheet width direction perpendicular to a sheet discharge direction to perform widthwise alignment; and a control unit, wherein the control unit, before a leading end of the sheet discharged by the sheet discharge unit reaches a sheet stacking surface at a top surface of the tray, executes sheet guiding processing in which at least one of the pair of cursors is positioned at a sheet guiding position that is farther inward in the sheet width direction than a lateral end surface of the sheet is, to contact a bottom surface of the sheet and guide the sheet toward the sheet discharge direction, the control unit, when the leading end of the sheet discharged by the sheet discharge unit passes a predetermined position above the at least one cursor during the sheet guiding processing, positions the at least one cursor positioned at the sheet guiding position at a retracted position that is farther outward in the sheet width direction than the lateral end surface of the sheet is, and the control unit, once a trailing end of the sheet discharged by the sheet discharge unit passes through the sheet discharge unit and the sheet is placed on the tray, executes the widthwise alignment processing by the pair of cursors, and wherein the post-processing mechanism includes a punching unit for punching binding holes in sheets, and in a case in which the sheets formed with the binding holes are discharged, the control unit moves the at least one of the pair of cursors from the sheet guiding position to the retracted position when, during the sheet guiding processing for a second sheet following a first sheet placed on the tray, a leading end of the second sheet passes the binding holes in the first sheet.

11. The sheet post-processing device according to claim 10, wherein in a case in which the binding holes are formed along a lateral end edge at one side in the sheet width direction, the control unit moves one of the pair of cursors that is located at the one side to the sheet guiding position to execute the sheet guiding processing.

12. An image forming device comprising:

an image forming unit that forms an image on a sheet; and the sheet post-processing device according to claim 10 that performs the post-processing on the sheet on which the image has been formed.

* * * * *